US012480319B2

(12) United States Patent
Ballantyne

(10) Patent No.: US 12,480,319 B2
(45) **Date of Patent: *Nov. 25, 2025**

(54) ROOF-ANCHORING SYSTEMS AND METHODS

(71) Applicant: Ballantyne Gear Inc., Mckinney, TX (US)

(72) Inventor: Flent Ballantyne, McKinney, TX (US)

(73) Assignee: Ballantyne Gear, Inc., McKinney, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/889,546

(22) Filed: Aug. 17, 2022

(65) Prior Publication Data

US 2023/0032045 A1 Feb. 2, 2023

Related U.S. Application Data

(63) Continuation of application No. 16/876,674, filed on May 18, 2020, now Pat. No. 11,459,779, which is a continuation-in-part of application No. 15/906,113, filed on Feb. 27, 2018, now abandoned.

(51) Int. Cl.
*E04G 21/32* (2006.01)

(52) U.S. Cl.
CPC ..... *E04G 21/3276* (2013.01)

(58) Field of Classification Search
CPC ..... E04G 21/3276; E04G 21/3295
See application file for complete search history.

(56) References Cited

U.S. PATENT DOCUMENTS

| | | | |
|---|---|---|---|
| 2,422,865 | A | 6/1947 | Tucker |
| 2,682,695 | A | 7/1954 | Kempkes |
| 3,336,068 | A | 8/1967 | Renfroe |
| 3,734,241 | A | 5/1973 | Hale |
| 3,924,539 | A | 12/1975 | Wladis |
| 4,398,620 | A | 8/1983 | Townsend |
| 4,399,893 | A | 8/1983 | Switzer |

(Continued)

FOREIGN PATENT DOCUMENTS

| | | |
|---|---|---|
| DE | 1852202 U | 5/1962 |
| DE | 3445682 A1 | 6/1986 |

(Continued)

OTHER PUBLICATIONS

Goblin-Rope Fall Arrester C.A.M.P. 1889-WORK, https://www.youtube.com/watch?v=thlKlgrDLKA, Jan. 31, 2013. You Tube. (Year: 2013).*

(Continued)

*Primary Examiner* — Kimberly T Wood
(74) *Attorney, Agent, or Firm* — Ballantyne Gear, Inc.; Robin L. Barnes

(57) ABSTRACT

An improved roof anchoring system configured as a non-penetrating fall protection system with no nails or screws damaging the roof and including simultaneously used multiple anchoring devices each with a connector pivotally attached to a corresponding axle and each preventing another anchoring device from moving away from the roof edge and tensioned with respect to such other anchoring device via a common tether. A stopper can be optionally used to keep a given anchoring device in place during installation of the anchoring system.

27 Claims, 23 Drawing Sheets

(56) References Cited

U.S. PATENT DOCUMENTS

| | | | | |
|---|---|---|---|---|
| 4,582,176 | A | 4/1986 | Roberts | |
| 4,795,141 | A | 1/1989 | Mulvaney | |
| 5,005,813 | A | 4/1991 | Lawrence | |
| 5,033,146 | A | 7/1991 | Fogarty et al. | |
| 5,036,949 | A | 8/1991 | Crocker | |
| D321,796 | S | 11/1991 | Forrand | |
| 5,137,112 | A * | 8/1992 | Nichols | E04D 13/12 248/237 |
| 5,316,103 | A | 5/1994 | Bell | |
| 5,361,558 | A | 11/1994 | Thornton et al. | |
| 5,427,209 | A | 6/1995 | Tannehill et al. | |
| 5,607,029 | A | 3/1997 | Beckham | |
| 5,730,246 | A | 3/1998 | Beard | |
| 5,848,783 | A | 12/1998 | Weissenborn | |
| 6,112,853 | A | 9/2000 | Beard | |
| 6,681,893 | B1 | 1/2004 | Coulson | |
| 6,805,220 | B2 * | 10/2004 | Fulton | A62B 35/0056 182/5 |
| 6,817,066 | B1 | 11/2004 | Williams et al. | |
| 7,686,566 | B1 | 3/2010 | Murphy | |
| 7,926,132 | B2 | 4/2011 | Jordan | |
| 8,038,106 | B2 | 10/2011 | Magno, Jr. et al. | |
| 8,096,384 | B2 | 1/2012 | Caylor et al. | |
| 8,292,030 | B2 | 10/2012 | Ballantyne | |
| 8,567,571 | B1 | 10/2013 | Neff et al. | |
| D720,278 | S | 12/2014 | Pinkall | |
| 9,248,323 | B1 | 2/2016 | Larsen | |
| 9,308,403 | B2 | 4/2016 | Strawder | |
| 9,744,387 | B1 | 8/2017 | Hung | |
| 9,884,209 | B2 | 2/2018 | Hwang | |
| 9,924,753 | B1 | 3/2018 | Soto et al. | |
| 10,071,268 | B2 | 9/2018 | Gaines et al. | |
| 10,760,336 | B2 | 9/2020 | Hwang | |
| 11,452,893 | B2 * | 9/2022 | Falgares | A62B 35/0068 |
| 2005/0189171 | A1 | 9/2005 | Bos | |
| 2006/0054399 | A1 | 3/2006 | Dudschus | |
| 2006/0156645 | A1 | 7/2006 | Munday et al. | |
| 2007/0272485 | A1 | 11/2007 | Baake | |
| 2010/0108442 | A1 | 5/2010 | Ballantyne | |
| 2012/0097406 | A1 | 4/2012 | Silcox et al. | |
| 2012/0312633 | A1 | 12/2012 | Massey | |
| 2016/0194890 | A1 | 7/2016 | Landry | |
| 2017/0259090 | A1 | 9/2017 | Gaines | |
| 2018/0272163 | A1 | 9/2018 | Colorado | |
| 2019/0262635 | A1 | 8/2019 | Ballantyne | |

FOREIGN PATENT DOCUMENTS

| | | | |
|---|---|---|---|
| DE | 3719953 | U1 | 12/1988 |
| DE | 29820510 | U1 | 12/1999 |
| DE | 202009013795 | U1 | 2/2011 |
| EP | 1205219 | A2 | 5/2002 |
| EP | 2246200 | A1 | 11/2010 |
| FR | 2638094 | | 10/1988 |
| GB | 2113285 | A | 8/1983 |
| GB | 2160571 | A | 12/1985 |
| GB | 2334292 | A | 8/1999 |
| JP | 10146397 | A | 6/1998 |
| JP | 2006102219 | A | 4/2006 |
| WO | 9949154 | A1 | 9/1999 |
| WO | 2006105837 | A1 | 10/2006 |
| WO | 2013125945 | A1 | 8/2013 |
| WO | 2013168839 | A1 | 11/2013 |

OTHER PUBLICATIONS

PCT International Search Report and Written Opinion, PCT/US2021/032895, Sep. 3, 2021, 11 Pages.

PCT International Search Report and Written Opinion, PCT/US2009/062695, May 19, 2010, 6 pages.

PCT International Search Report and Written Opinion, PCT/US2020/033547, Sep. 8, 2020, 16 pages.

Safefall Supply, G-Clamp Temporary Fall Protection System Demo Video, Jun. 6, 2018, https://www.youtube.com/watch?v=qRtAju9VYMw.

Grainger, Black Steel with Rubber Cam Mop and Broom Holder, 12 PK, Product Information, https://grainger.com/.2019, 1 page.

C.A.M.P. SpA GOBLIN Instruction Manual; Via Roma, 23-23834 Premana (LC)—Italy; https://www.camp.it/d/us/us/corporate; https://www.camp.it/d/us/us/work/product/983 Jan. 2023.

C.A.M.P. Goblin Descender; Ref. 0999-099909; https://www.abaris.co.uk/camp-goblin-fall-arrester; https://youtu.be/RAueY80TYGk; https://youtu.be/thlKlgrDLKA Mar. 14, 2022.

Kong Back-Up Fall Arrester; https://www.kong.it/en/product/back-up/; https://youtu.be/j7avRWYrDsU; retrieved Dec. 21, 2023 Dec. 21, 2023.

Photographs 1-5 of Double Travel Restraint Technique provided by Greg Small from engineering course; date unknown, but believed to be in 2012.

PowerPoint Presentation of Double Travel Restraint Technique provided by Greg Small from engineering course; date unknown, but believed to be in 2014.

* cited by examiner

ROOF-ANCHORING SYSTEMS AND METHODS

CROSS-REFERENCE TO RELATED APPLICATIONS

This patent application is a continuation of U.S. application Ser. No. 16/876,674 filed on May 18, 2020, now U.S. Pat. No. 11,459,779, which is a continuation-in-part from the U.S. patent application Ser. No. 15/906,113 filed on Feb. 27, 2018, the disclosures of which are incorporated by reference herein.

RELATED ART

Different types and configurations of anchorages and anchorage systems are used for fall restraint, fall arrest, and rope access in construction, repair, inspection and other industries. Such systems are configured to prevent injury or death by restraining a person from falling and/or arresting a fall, and also used to assist with rope access.

For example, WO9949154 illustrates a safety system (for roof workers) that includes roof-fixing means adapted to be connected to a roof edge of one side of the roof along with a harness worn by a roof worker located on the opposite side of the roof A safety rope is used to connect the harness to the roof-fixing means. The roof-fixing means may be structured as a roof anchor with a hook (which, in operation, hooks or fastens to the lower edge of the roof cladding or rooftop—such as metal sheet—or roofing tile). A clamping bolt fixes the roof anchor to the cladding.

U.S. Pat. No. 8,292,030 teaches an anchoring system in which the roof-fixing means may be structured as a wheeled "hook member" that is adapted to be mounted to an eave or similar roof structure. The described hook member has a tether affixed to the hook body. The shortcoming of the described design stems from the possibility that the hook member, once mounted on the roof, can possibly move or become dislodged if the tether attached becomes loose from stretching, incorrect installation, lack of proper maintenance or any other reason and then the hook body is pulled or otherwise abruptly moved from a pull or abrupt motion from the tether that is attached to the anchoring hook. If the anchoring hook body becomes dislodged, a user is vulnerable to the risk of a serious or fatal fall.

Known to-date systems and mechanisms of related art are rather complex and difficult to cooperate with the roof, while the preparation to employing these systems is time consuming and may cause permanent damage or unattractive modification to at least a portion of the roof.

SUMMARY

Embodiments of the invention provide systems and methods for forming and maintaining a secure attachment to a roof of a building for use as a non-penetrating fall protection system with no nails or screws damaging the roof to prevent detrimental and/or damaging outcomes to persons and property. This method includes a step of positioning a first wheeled roof-anchoring device at or near a first edge of the roof such that a first set of wheels with a corresponding first axle are located under and in a first tensioned contact with the first edge (while a second set of wheels with a corresponding second axle are in contact with and on the roof and a first connector pivotally attached to the second axle is under tension due to a first force pulling such first connector away from the second axle along—for example, up—the roof). Here, the first roof-anchoring device includes a first arched body having first and second ends, the first axle with the first set of wheels juxtaposed with the first arched body at the first end, the second axle with the second set of wheels juxtaposed with the first arched body at the second end, and the first connector.

The method additionally includes a step of disposing a second wheeled roof-anchoring device near a second edge of the roof such that a third set of wheels with a corresponding third axle are located under and in a second tensioned contact with the second edge (while a fourth set of wheels with a corresponding fourth axle are in contact with and on the roof and a second connector pivotally attached to the fourth axle is under tension due to a second force pulling such second connector away from the fourth axle and along—for example, up—the roof). Here, the second roof-anchoring device includes a second arched body having third and fourth ends, the third axle with the third set of wheels juxtaposed with the second arched body at the third end, the fourth axle with the fourth set of wheels juxtaposed with the second arched body at the fourth end, and the second connector. Notably, the said first and second connectors are linked with a tether line under strain chosen to maintain the first and second tensioned contacts while preventing the first and third sets of wheels from moving away from first and second edges of the roof.

Generally, the method may additionally include at least one of the steps of:

- configuring said tether line such that the step of preventing the first set of wheels from moving substantially relative to the first edge of the roof is caused only by the tensioned contact of the third set of wheels with the second edge of the roof, and the step of preventing the third set of wheels from moving substantially relative to the second edge of the roof is caused only by the tensioned contact of the first set of wheels with the first edge of the roof;
- disengaging at least one of the first and second wheeled devices from a stopper disposed below or under an axle of such at least one of the first and second devices to cause said stopper to fall from a corresponding edge of the roof;
- attaching a connecting element between a user's harness 176 (shown in FIGS. 13-14) and a lifeline or an element of the user's harness to the lifeline to permit at least one of sliding and anchoring of the respective element over and along the lifeline from every first point of the lifeline to every second point of the lifeline, both the first point and the second point defined between the attachment of the lifeline to the tether line and the opposite end of the lifeline;
- attaching a connecting element between a user's lifeline and the tether line or support line, or an element of the user's lifeline to the tether line or support line to permit at least one of sliding and anchoring of the respective element over and along the tether line from every first point of the tether line to every second point of the tether line, both the first point and the second point defined between the between the first and second connectors of the first and second anchoring devices.

The attachment of the slidable and anchorable element of the harness to a lifeline, combined with the attachment of the slidable and anchorable element of the lifeline to a tether line or support line constituent to the anchor device is significant, since a person that works at a high risk job, such as cleaning rain gutters or installing Christmas lights is required to work along the edge of the roof and is at a high risk of falls. Using a rope grab as the harness element and also using another rope grab as the lifeline element, with a rope grab that will slide freely in one direction and will only go in the reverse direction with deliberate actions to the rope grab, a person can attach their lifeline to a tether line, common tether line or support line that is parallel to a roof edge, and using the slidable and anchorable element of the harness to the lifeline, he can adjust the length of his lifeline so he is able to reach the edge where he is working and not be at risk of falling from this working edge. When a person working on the roof edge moves along the working roof edge, the lifeline element will slide along the tether line or support line and will follow the person. However, if the user is working on a sloped roof edge he will have two fall hazards, he can fall off the edge where he is working and he can roll down the slope and fall off an edge that is axially connected to the edge where the user is working. The element of the harness to the lifeline will prevent the person from falling off the roof edge where the person is working and if the person starts to slide down the slope of the roof, the harness element will prevent the person from sliding down the lifeline and the lifeline element will prevent the lifeline from sliding down the tether line.

In one implementation of the method, the step of disposing includes disposing the second roof-anchoring device near or at the second edge that is opposite to the first edge. In a related and non-exclusive implementation, at least one of the steps of positioning and disposing includes at least one of the following: a) locating a chosen roof-anchoring device, from the first and second roof-anchoring devices, on the roof such that all wheels of such chosen device are in contact with a rooftop; and causing such chosen device to wheel to a corresponding edge of the roof, from the first and second edges of the roof, at least until a set of wheels of the chosen device closest to the corresponding edge loses contact with the roof; b) repositioning the chosen device along a wall of the building up towards the roof until an axle—to which a corresponding connector (from the first and second connectors) is attached—is positioned above the corresponding edge of the roof while a set of wheels on an axle opposite to the corresponding connector is under and in contact with an edge of the roof; and c) pivoting at least one of the first and second connectors at two locations with respect to a corresponding axle. Alternatively or in addition, the method may further include one of the following: i) after the steps of locating and causing, wheeling the chosen roof-anchoring device up the roof to pull the set of wheels that has lost contact with the roof under the roof in a tensioned contact with the corresponding edge; and ii) wheeling the chosen device such that an axle at a side of the chosen device with the corresponding connector travels along the roof away from the corresponding edge to pull an axle that is opposite to the corresponding connector under the roof in the tensioned contact with the corresponding edge. Additionally or in the alternative—and also with respect to this latter case—the step of locating may include placing a stopper on the roof between the corresponding edge and the axle closest to the corresponding edge; and engaging the wheels on said axle closest to the corresponding edge with the stopper to prevent further movement of the chosen device towards the corresponding edge.

Furthermore, the method may additionally include the step of positioning a third wheeled roof-anchoring device at or near a third edge of the roof such that a fifth set of wheels with a corresponding fifth axle are located under and in a third tensioned contact with the fifth edge (while a sixth set of wheels with a corresponding sixth axle are in contact with and on the roof and a third connector pivotally attached to the sixth axle is under tension due to a third force pulling the sixth connector away from the sixth axle, up the roof). Here, a structure of the third roof-anchoring device may be substantially equivalent to a structure of the first roof-anchoring device, and the third force is caused as a result of tensioned attachment of an element of the third roof-anchoring device to the tether line at a support point between the first and second roof-anchoring devices with the use of a support line, that is transverse to the tether line. Alternatively or in addition, the method may include i) attaching a first connecting element between a user's harness and the tether line or a first element of the user's harness to the tether line, and ii) attaching a second connecting element between the user's harness and said support line or a second element of the user's harness to the support line in order to permit at least one of a) one of sliding of a respective element over and along the tether line from every point of the tether line to every other point of the tether line between an end of the tether line and a support point, and anchoring the respective element at the tether line between the end of the tether line and the support point; and b) one of sliding of the other respective element over and along the support line from every point of the support line to every other point of the support line between an end of the support line and the support point, and anchoring the other respective element at the support line between the end of the support line and the support point.

BRIEF DESCRIPTION OF THE DRAWINGS

Advantages of embodiments of the present invention will be apparent from the following detailed description of the several not-mutually-exclusive embodiments, which description should be reviewed with references to the accompanying drawings, in which:

FIG. 5A shows the stop member coupled to (in operational juxtaposition with) an embodiment of the anchoring device, while

Figure 8A:
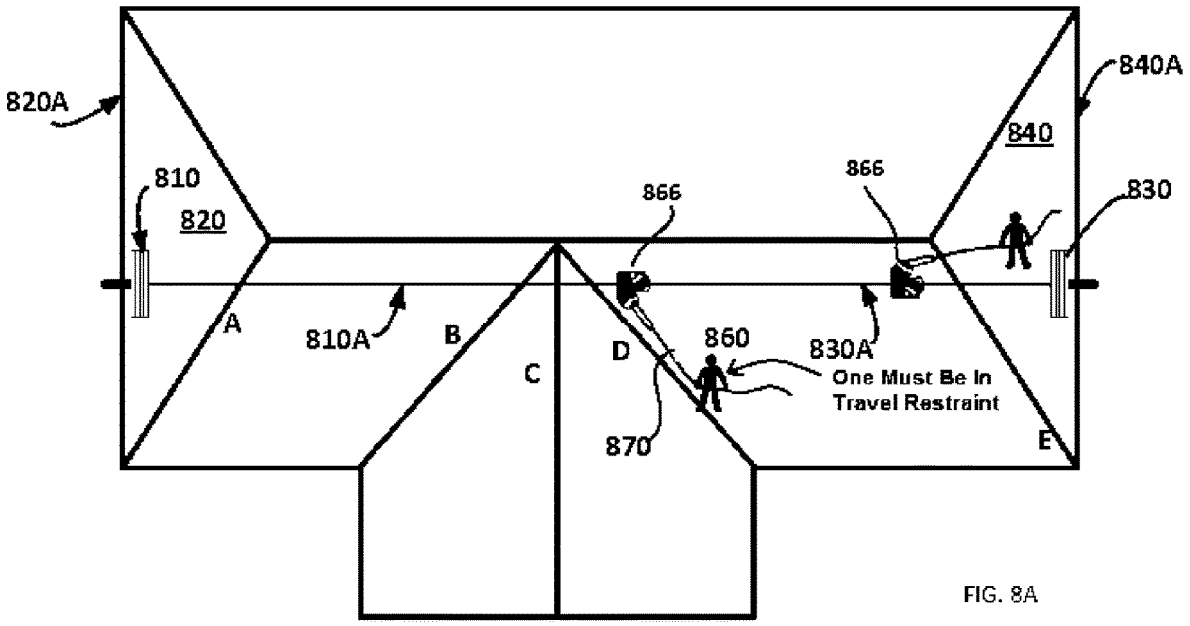
Figure 8B:
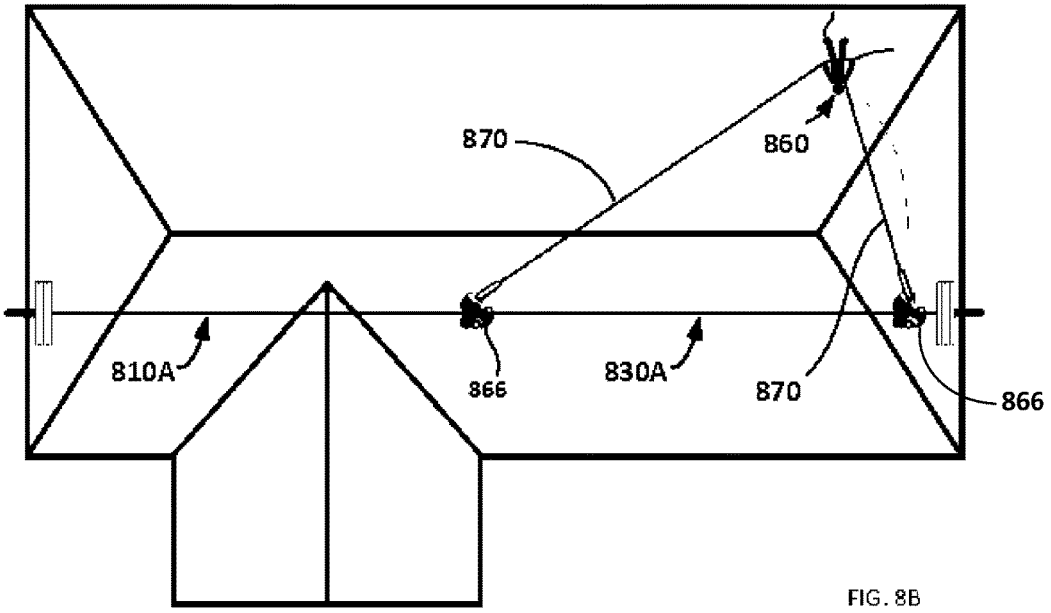
Figure 9A:
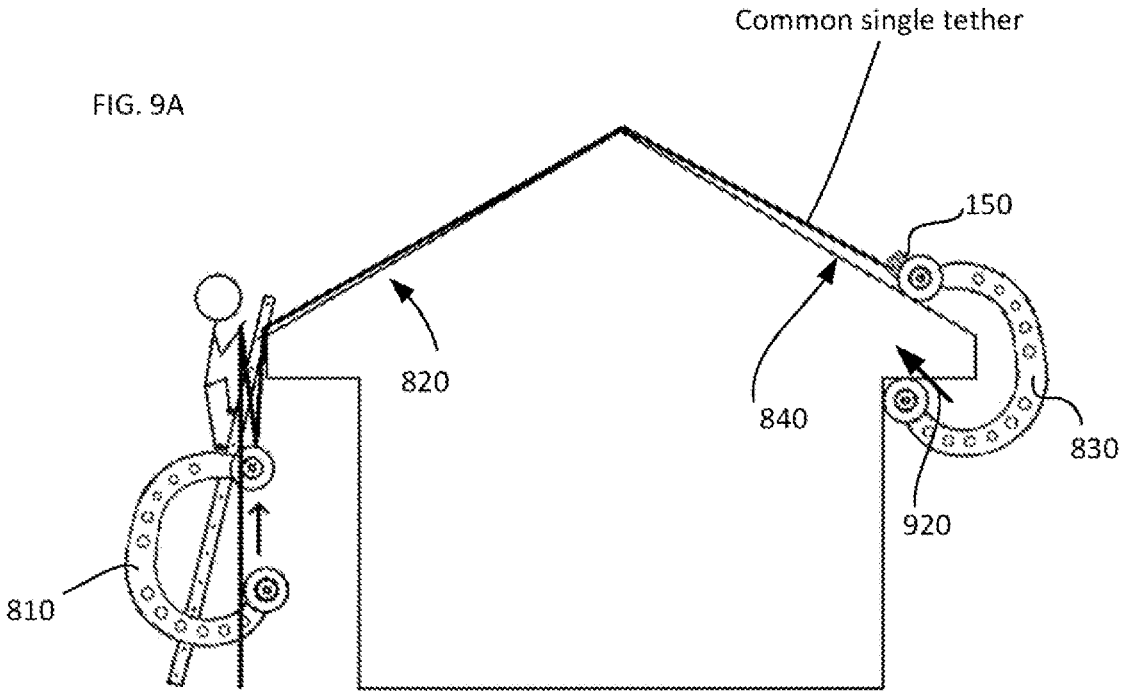
Figure 9B:
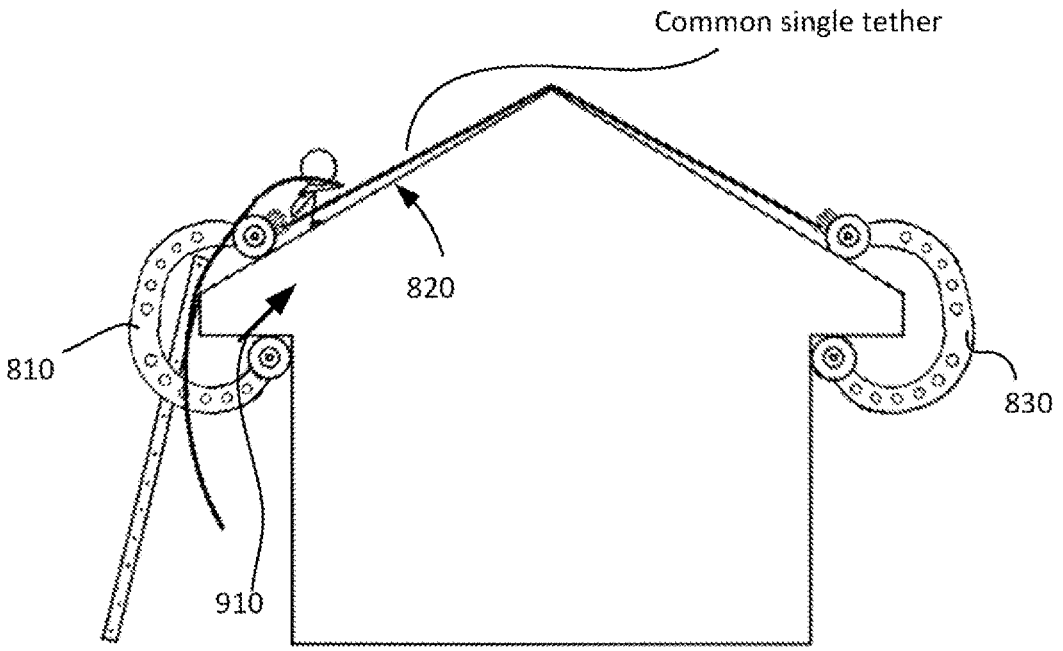
Figure 10A:
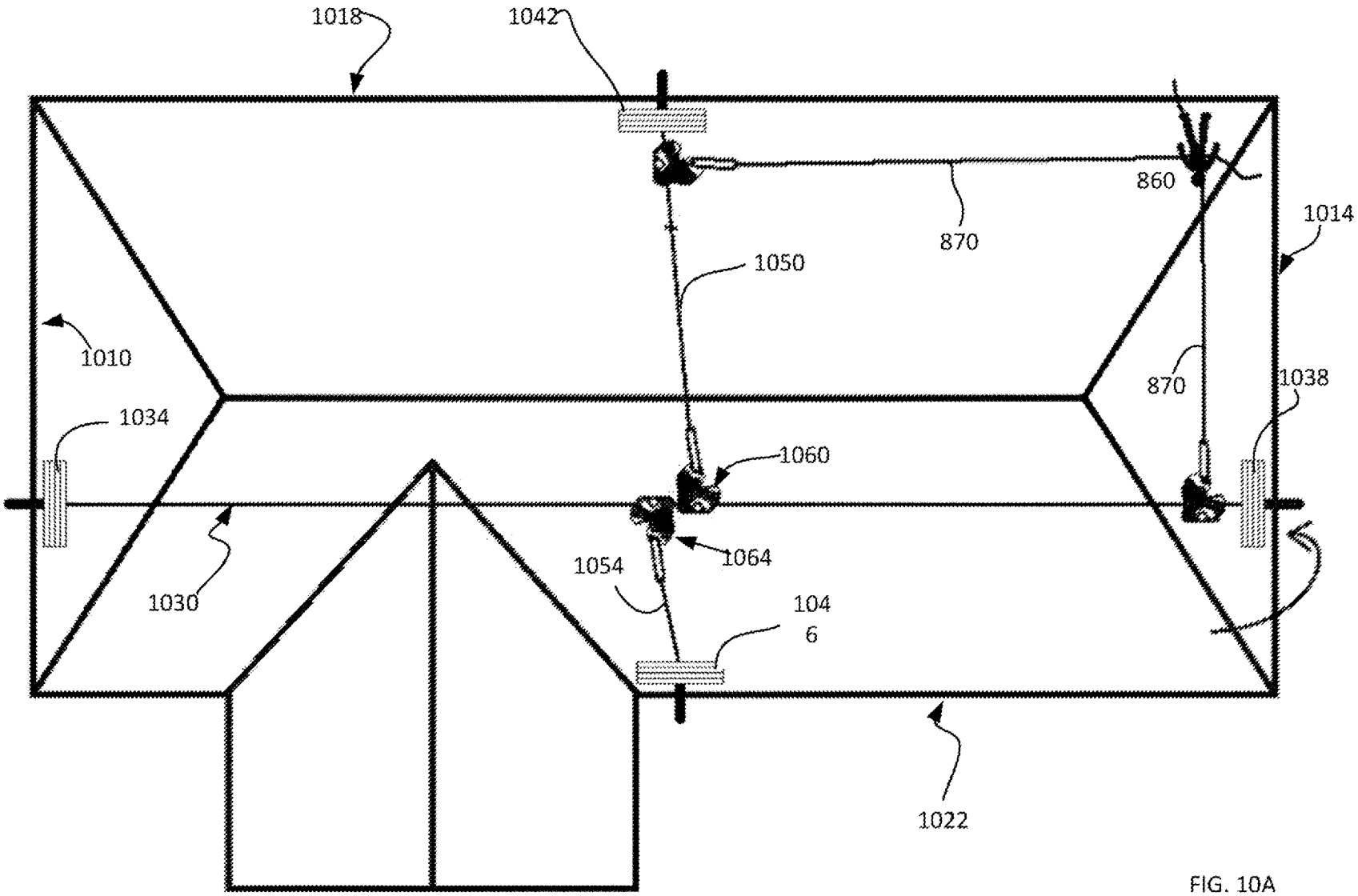
Figure 10B:
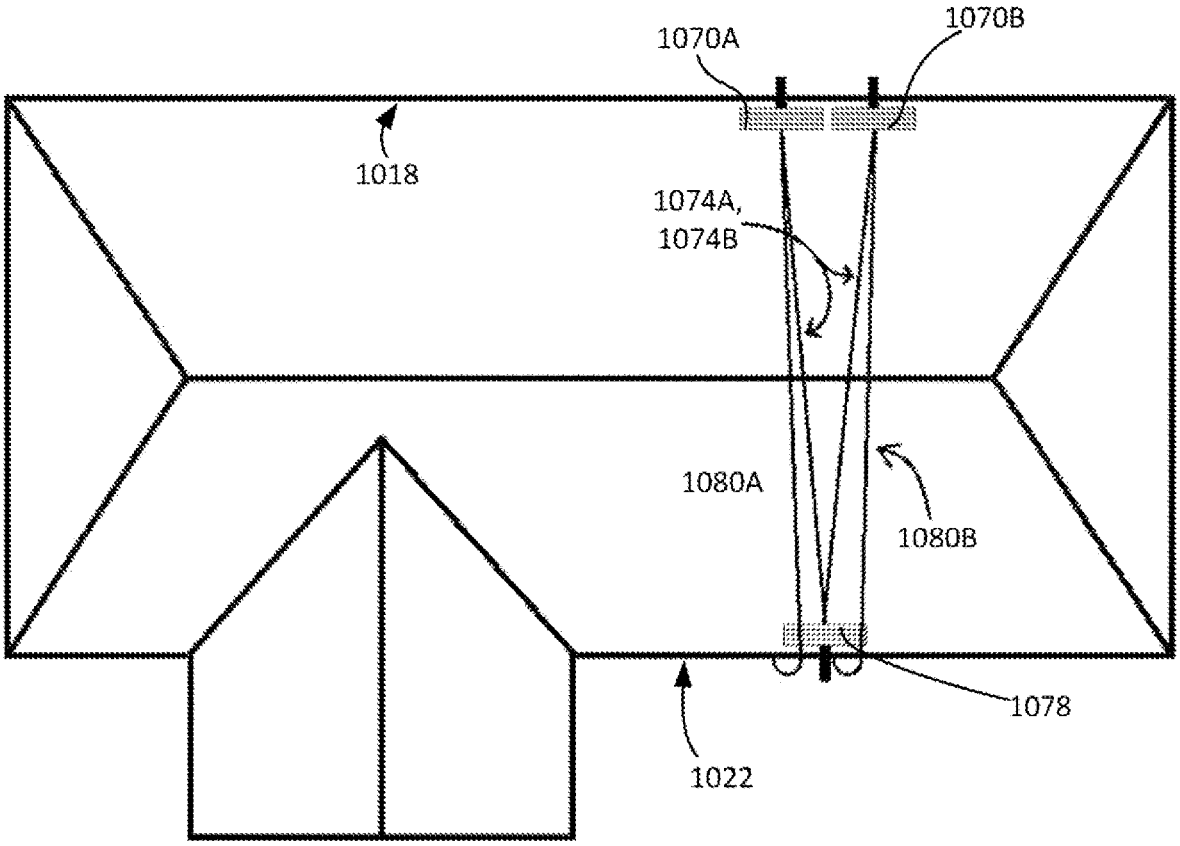
Figure 10C:
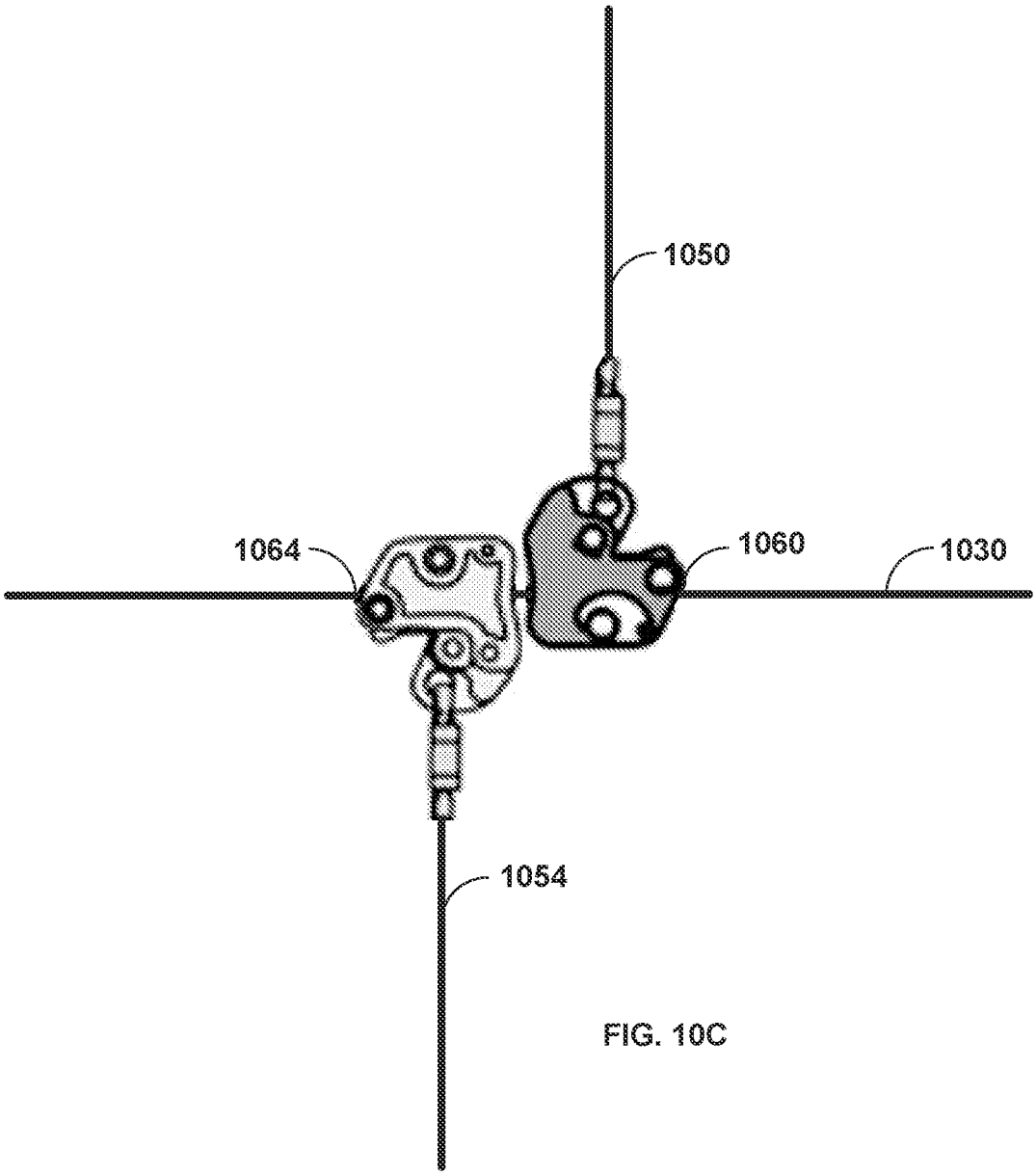
Figure 11:
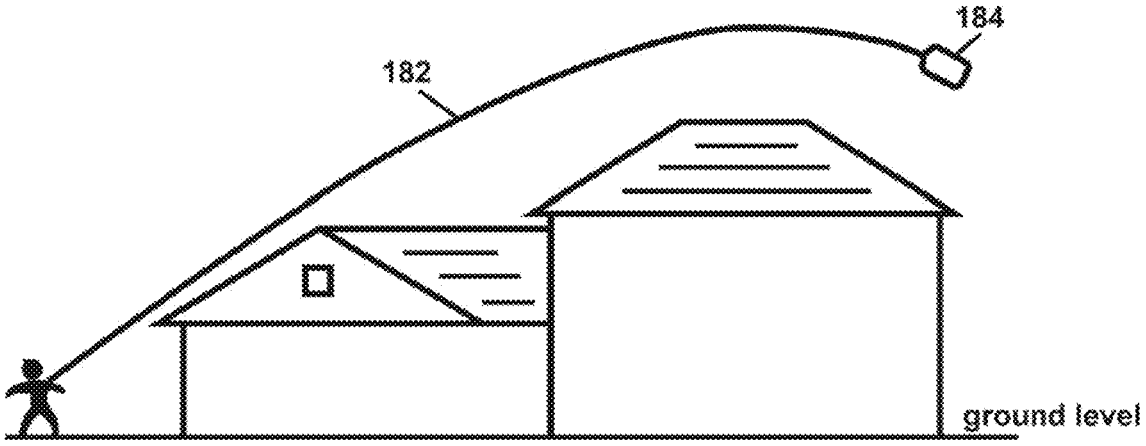
Figure 12:
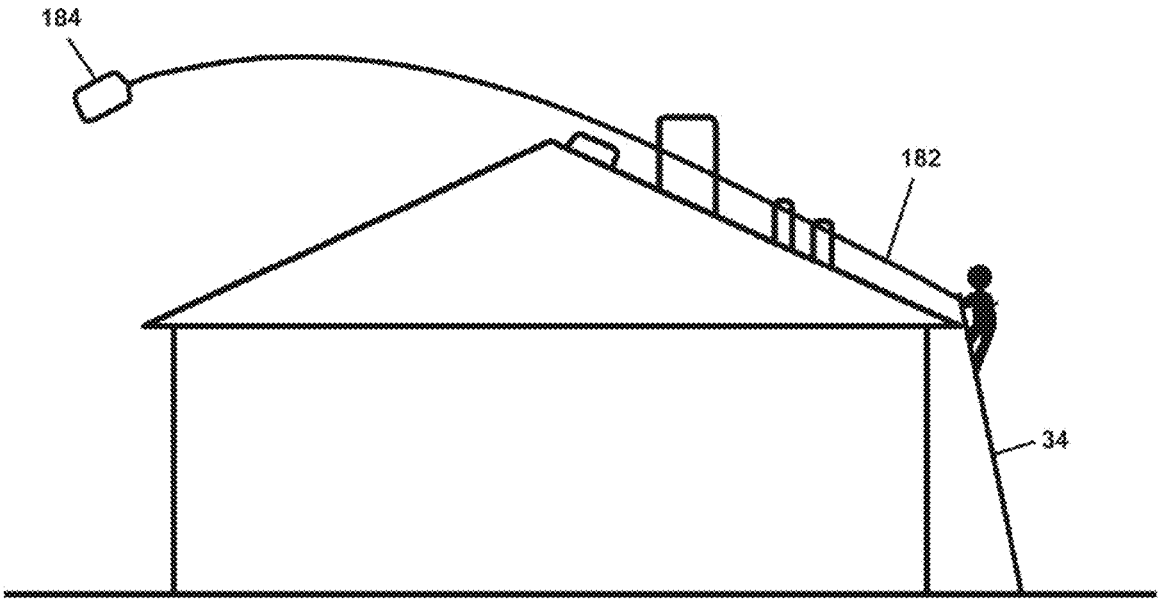
Figure 13:
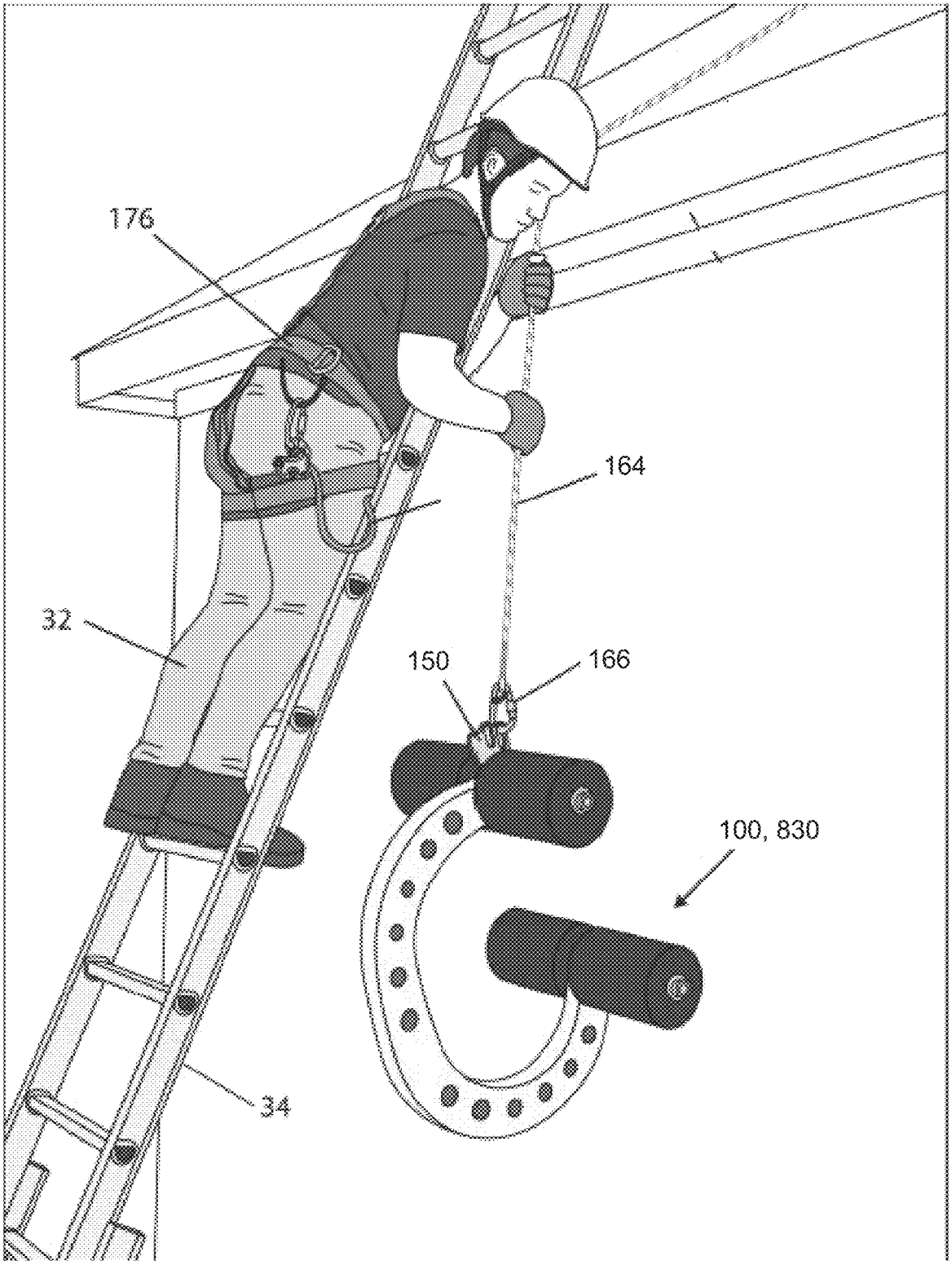
Figure 14:
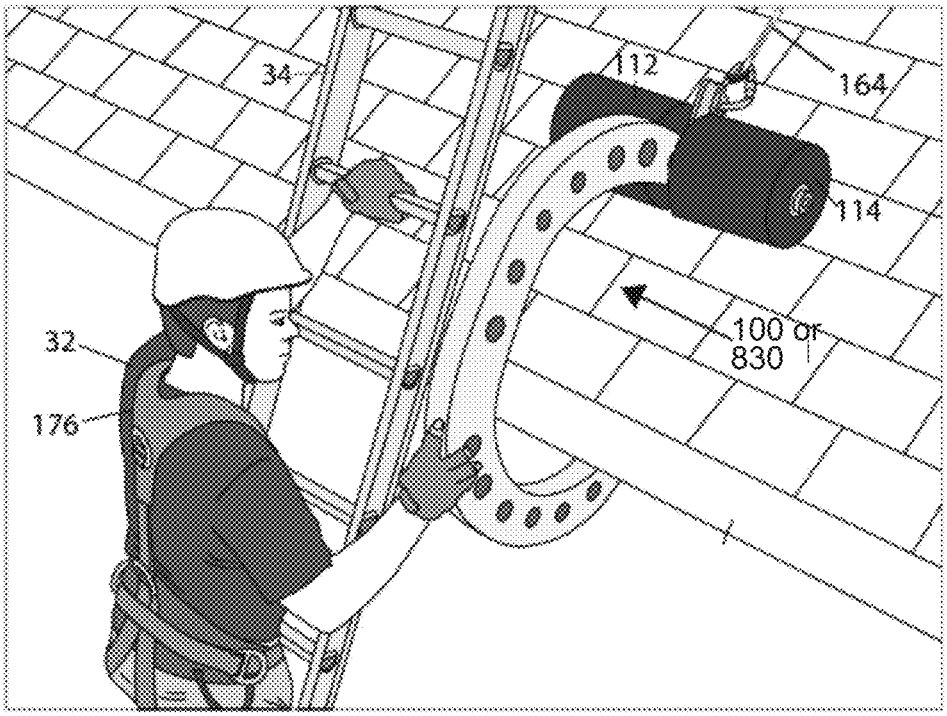

FIGS. 8A, 8B are schematic illustrations of the process for forming and maintaining a secure attachment to the roof of a building;

FIGS. 9A, 9B provide additional simplified schematics in support of the process described in reference to FIGS. 8A, 8B: standard attachment of an additional anchor device on the second side of the roof with the use of a progress capture type device and utilizing a single tether;

FIGS. 10A, 10B show non-limiting related implementations of the secure attachment to the roof;

FIG. 10C shows non-limiting related implementations of a secure attachment to the roof in which two tether line slidable elements are connected to a single tether line in opposing orientations;

FIG. 11 shows a throw line being thrown across a roof prior to running the tether across a roof according to one embodiment;

FIG. 12 shows a throw line being thrown across a roof prior to running the tether across a roof according to another embodiment;

FIG. 13 shows a preferred embodiment of part of a method of installing a roof anchor after running the tether line across the roof as shown in FIG. 11 or 12 by lifting a first wheeled roof-anchoring device with the assistance of a ladder;

FIG. 14 shows a preferred embodiment of another part of a method of installing a roof anchor onto a roof by positioning the first wheeled roof-anchoring device on the roof's surface and under the edge of the roof after the step shown in FIG. 13.

Figure 15:
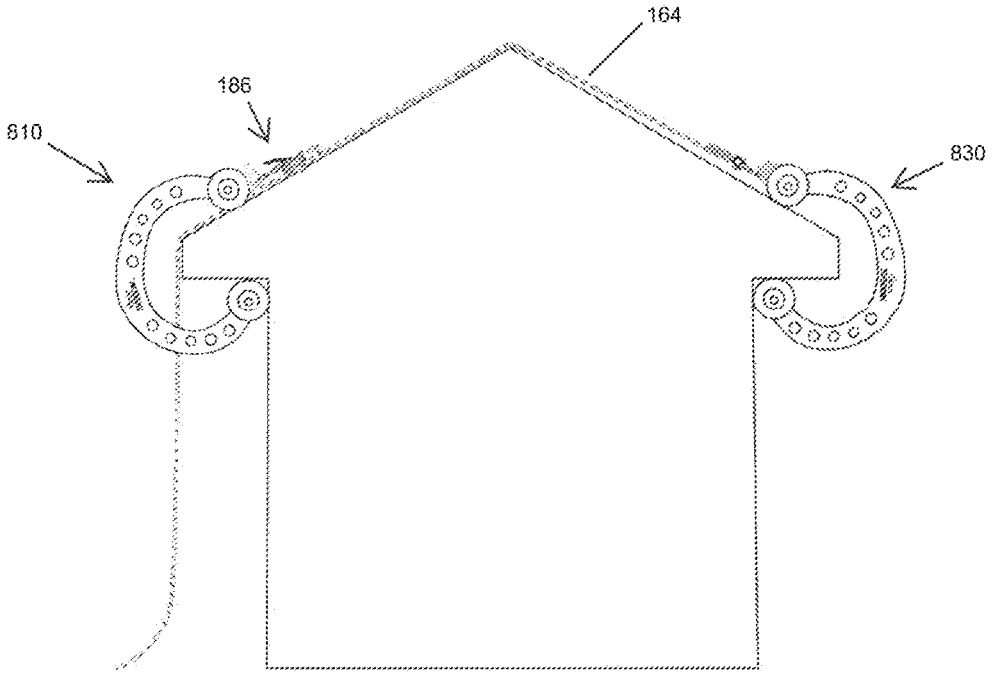

FIG. 15 is a front view showing roof anchoring devices that are attached to two sides of the roof, with a common single tensioned tether between them that is holding them to the roof edges.

Figure 16:
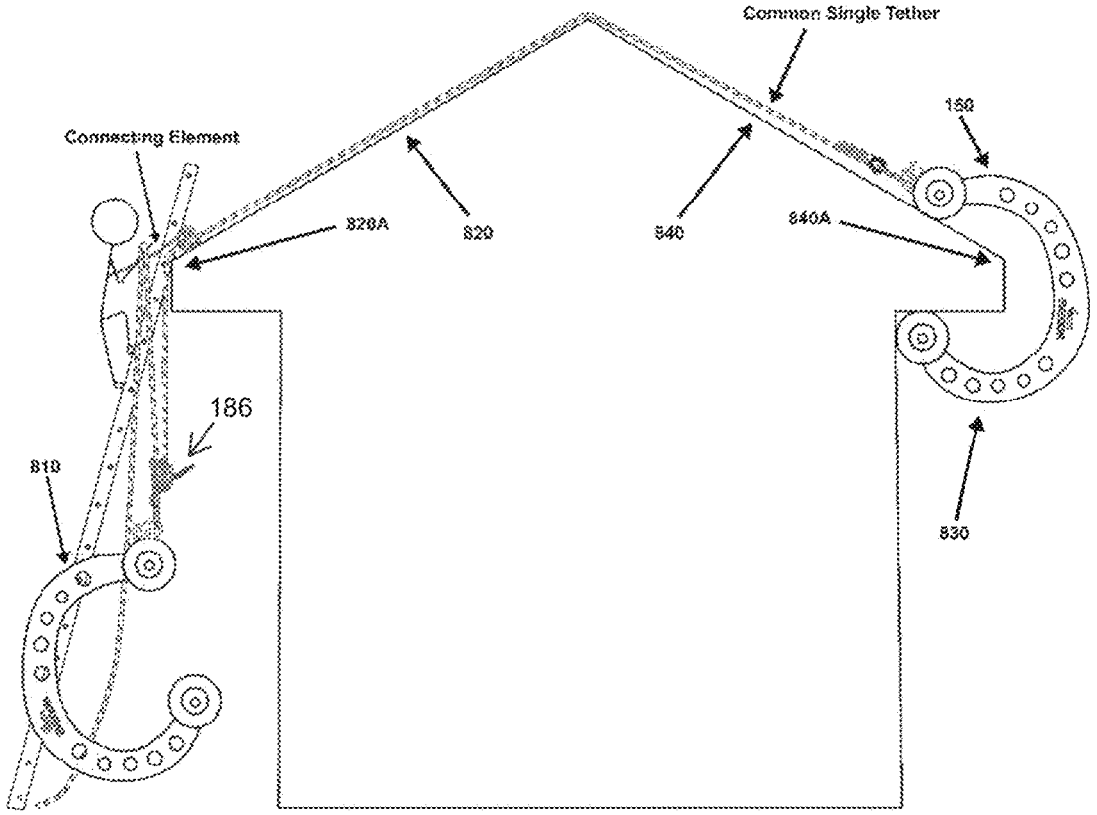
Figure 17:
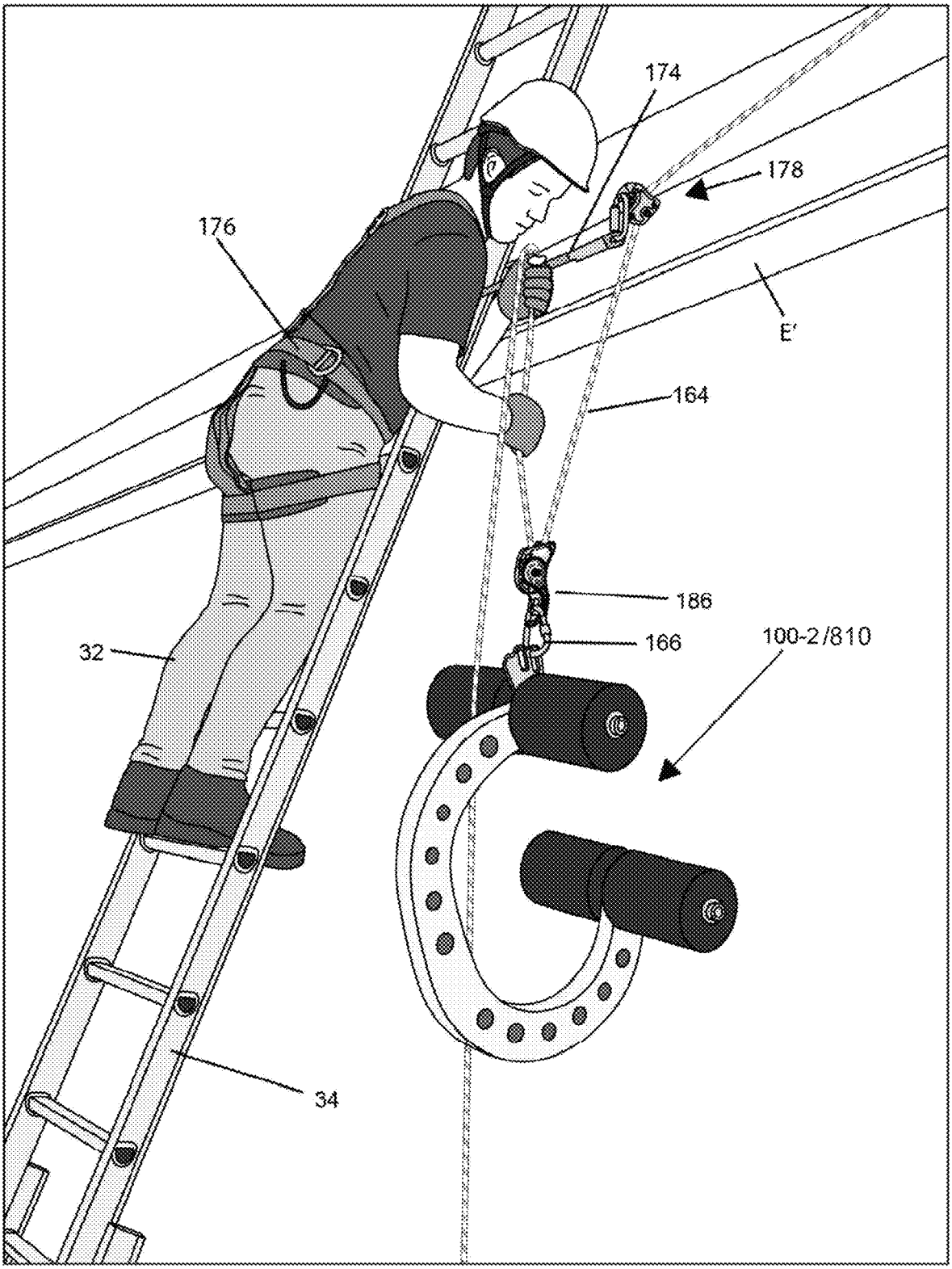

FIGS. 16 and 17 are front and perspective views, respectively, showing a first roof anchoring device that is attached to a roof edge by a tensioned line. The line is tensioned to the first anchoring device by the weight of a roof anchoring device hanging from the opposite side and possibly also by the attachment of the user to the common single tether line by use of a connecting element or elements from the harness to the common tether line. The worker is lifting the roof anchoring device with the tether line and a progress capture pulley or similar tensioning device.

Figure 18:
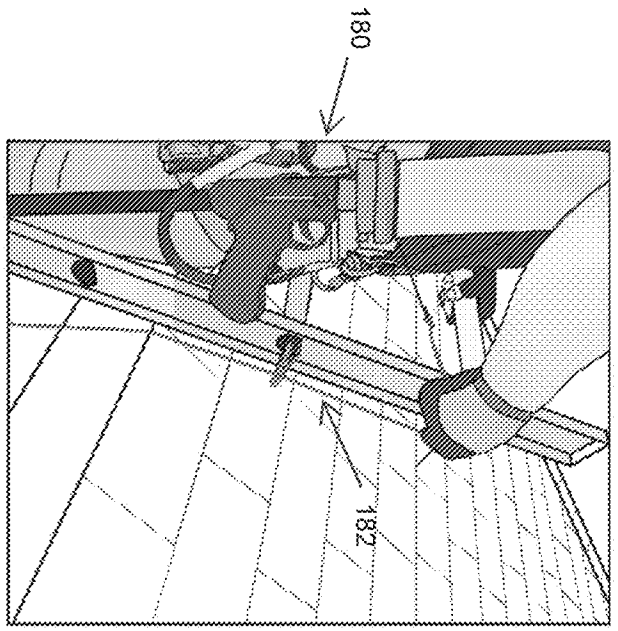

FIG. 18 is a perspective view of a worker that is at the top of the ladder with the line thrower that is that is attached to a projectile that is attached to the throw line with the throw line connected to the ladder.

Figure 19:
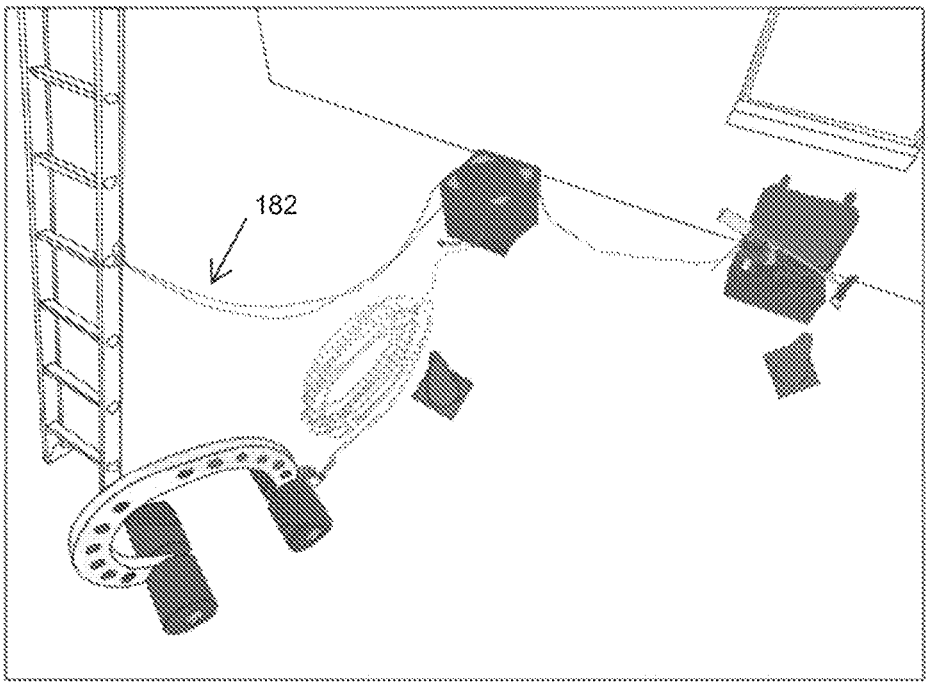

FIG. 19 is a perspective view of an example of a line-thrower with a projectile that is attached to a throw line, which is attached to a tether line that is attached to a roof anchoring device.

Figure 20:
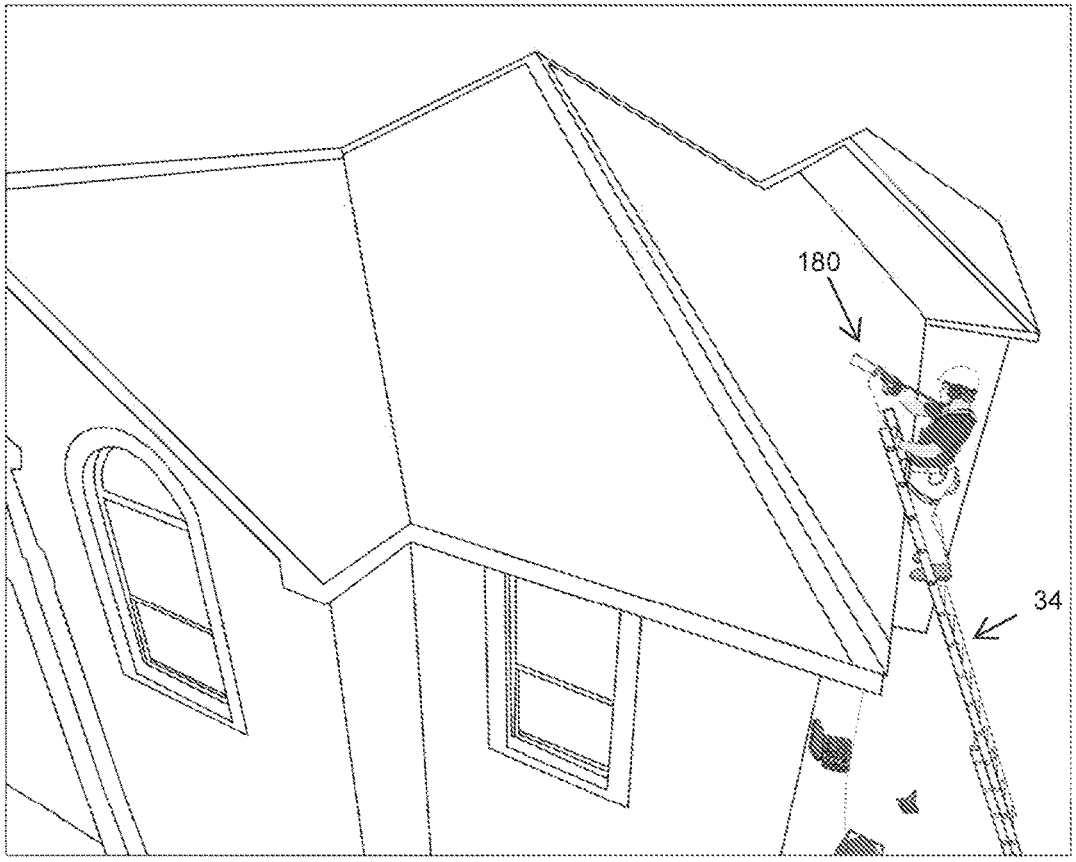
Figure 21:
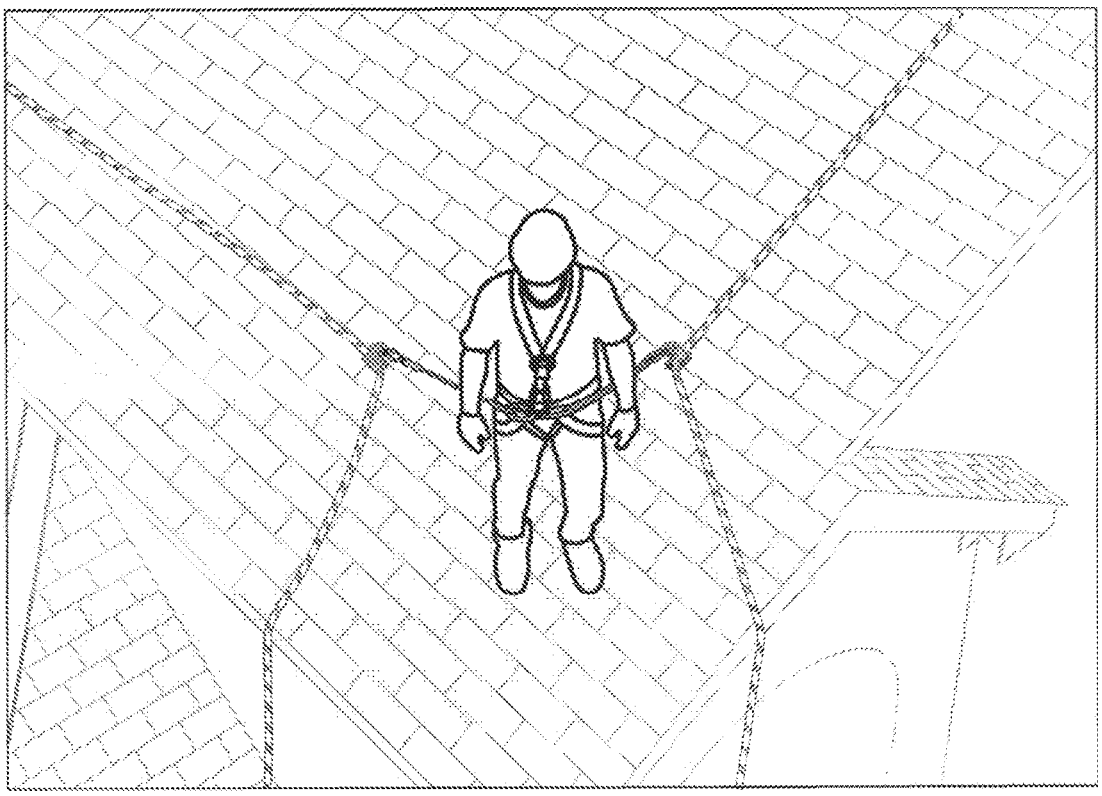
Figure 22:
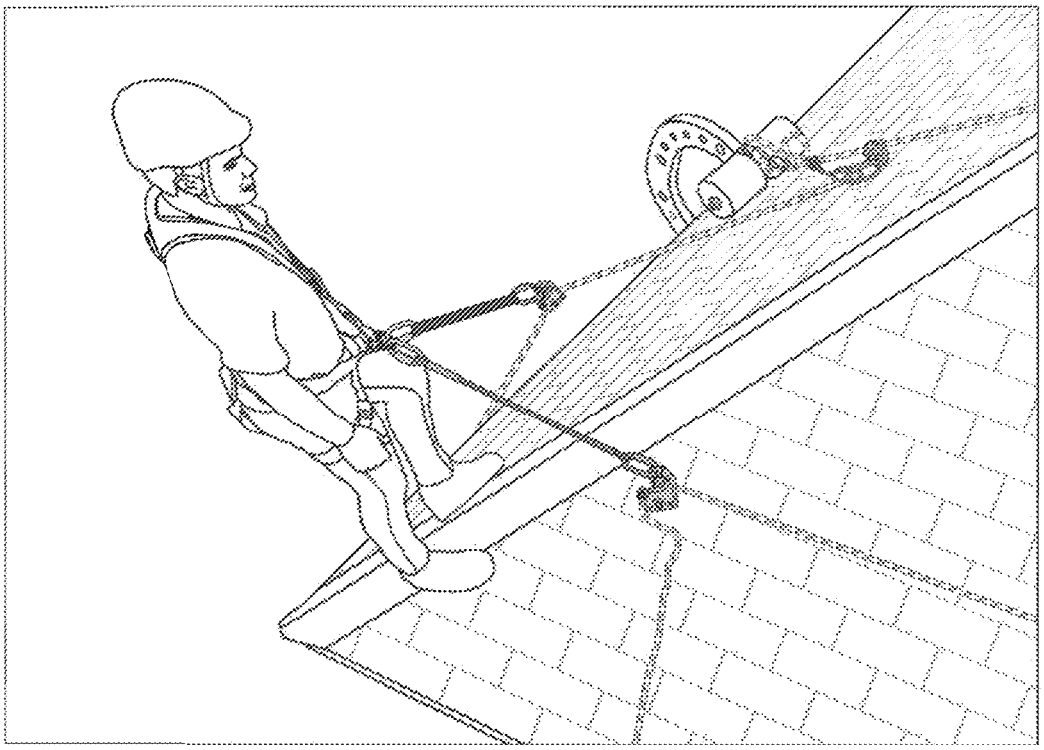
Figure 23:
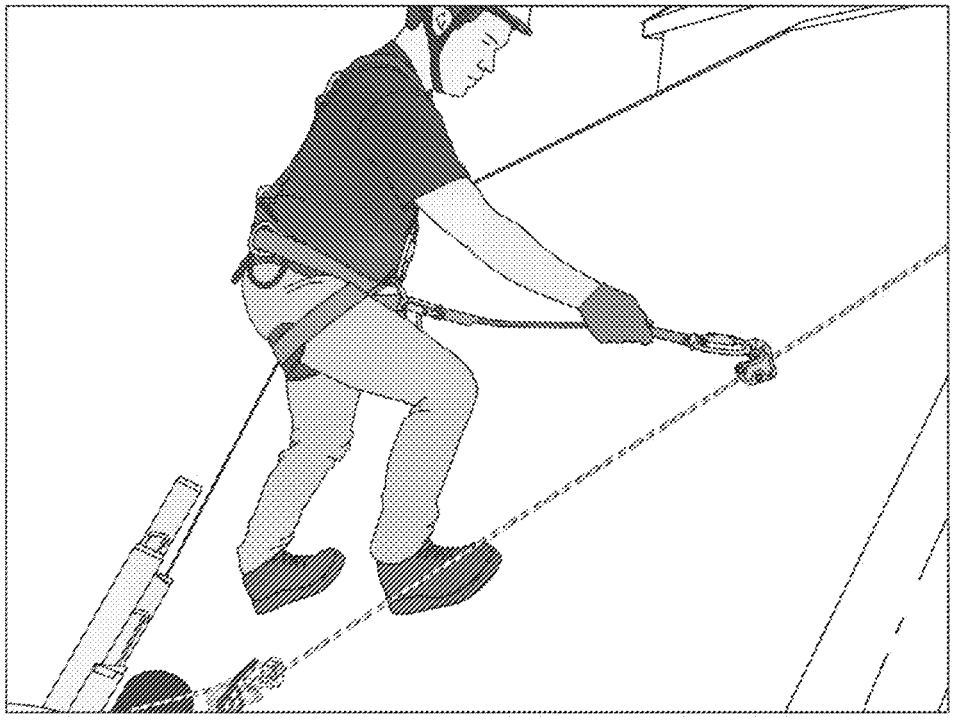

FIG. 20 is a perspective view of a worker that is ready to launch the throw line across the roof.

Figure 24:
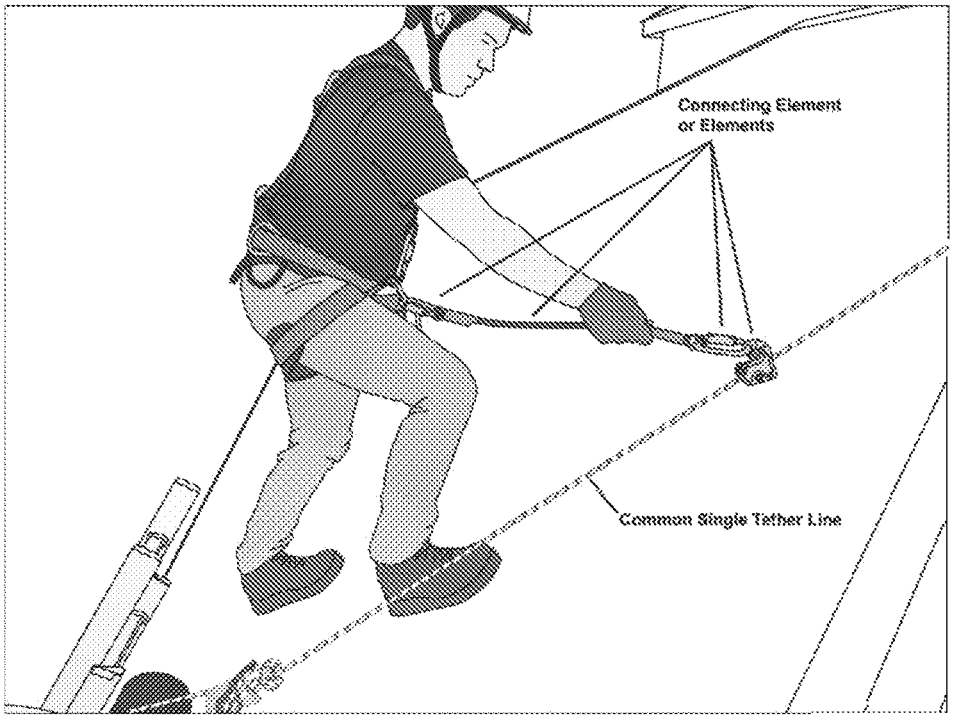
Figure 25:
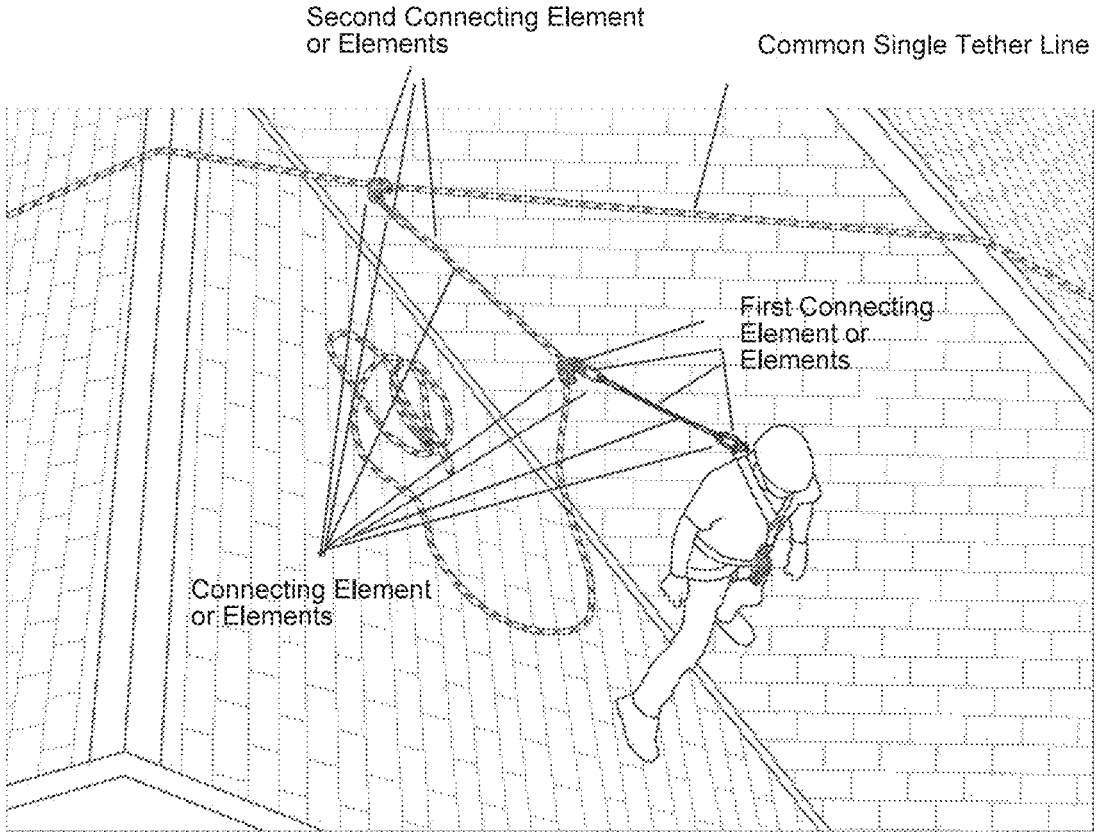
Figure 26:
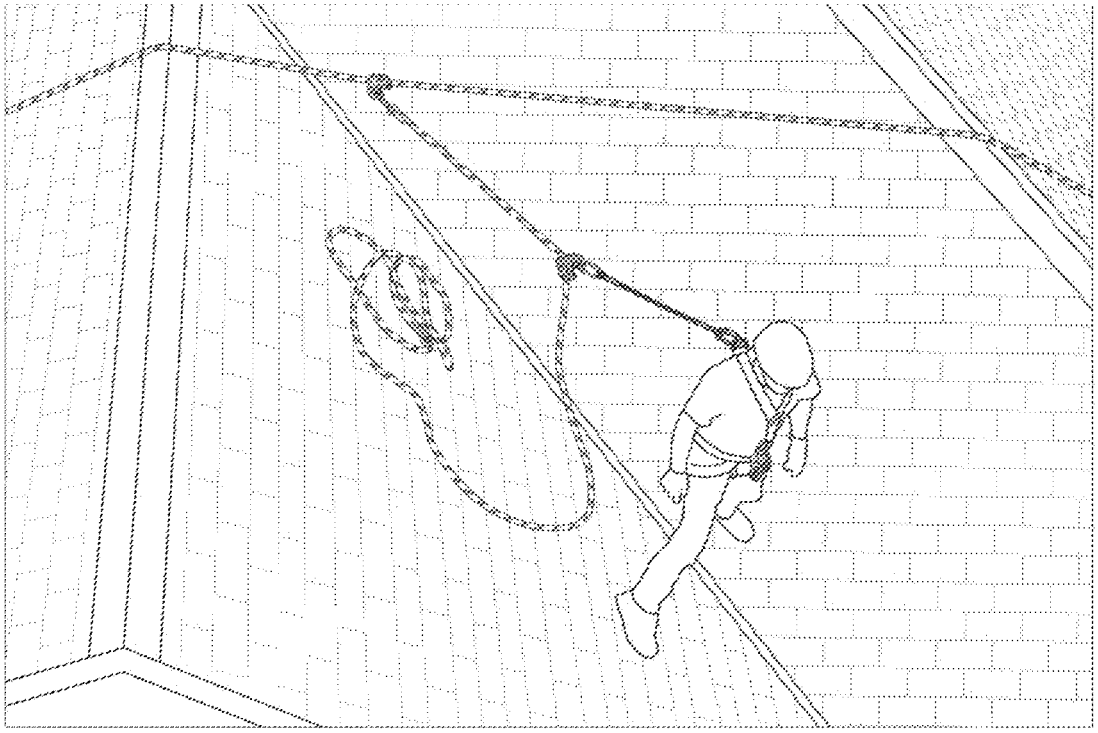

FIGS. 21-26 show different perspectives of non-limiting related implementation of the secure attachment to the rooftop with a worker attached to a tensioned tether line with various connecting elements, with connecting elements labeled in FIGS. 24-25.

In the Drawings, generally, like elements and/or components may be referred to by like numerals and/or other identifiers; not all elements and/or components shown in one drawing may be necessarily depicted in another, for simplicity of illustrations.

DETAILED DESCRIPTION OF THE INVENTION

Roof-anchoring systems of related art do not allow a worker on the roof to be, on the one hand, securely connected to the roof to prevent falling to the ground and, on the other hand, to move about the roof, regardless of the length of the link that is between the harness of the worker and the system of anchoring to the roof The problem of operationally-inadmissible dislodging of a roof anchor, mounted to the eave (or edge, or overhang portion) of the roof with one of its wheel axles under the eave, as a result of a movement of the tether connected with such roof anchor at its opposite end is solved by tensionally straining such roof anchor against a second roof anchor that has been also mounted to another eave of the roof to form a specific anchor assembly. Such anchor assembly is structured as a system of multiple anchor devices, the respectively-corresponding single tether connecting two or more anchor devices, or tethers of which are substantially directly attached to one another at a predetermined location(s) with two or more anchor devices (configured according to the idea of the invention), with the tether line or tether lines along the roof between constituent anchors, each of which is meanwhile securely fastened to a corresponding eave of the roof due to tensile stress caused by its being connected to another anchor. Supporting tether lines can also come from the sides of the tensioned tethers, attaching axially to reinforce the original tensioned tethers and attached to another anchoring device. The location of a substantial direct attachment between the constituent, individual tethers (that, when attached to one another, form a joined or common tether line) can be varied at the discretion of the user and may be generally chosen away from the summit (ridge) of the roof—that is, on one of the roof slopes. As a result of attaching the tether line or lines of constituent anchors together substantially directly while avoiding and not forming a point of fastening of the common tether line with the roof, the user of the anchor assembly (a worker on the roof) gains an advantage of having a point of attachment of an element of the worker's lifeline to the tether line (common tether line or support line, as used interchangeably herein) connecting the different anchors to be repositionably (for example, in a sliding fashion) moved along the such common tether line if desired. This may be achieved by removably attaching a user's lifeline element (a rope grab, carabiner, snap hook, ring, or a similar device, for example) to the common tether line such as to allow this lifeline element to slidingly move along and over the common tether line to substantially any location of the common tether line between the constituent anchors while optionally avoiding a fixation of the lifeline element at any predetermined location, if preferred, or anchoring to any location along such line.

Notably, the formation of such common tether line does not prevent the user from additionally fastening the common tether line to the roof at substantially any point along the tether line, if desired, and change a location of such fastening when desired. In this specific case, the extent of relocation of the element coming from the lifeline along the common tether line is defined by a stretch of the common tether line between a constituent anchor and the location of fastening. Attachments to the tether lines from other connections or obstacles may also stop the sliding relocation but methods can be used to transfer across these obstacles.

The user of the anchor assembly (a worker on the roof) gains an additional advantage of having a point of attachment of an element of his harness to the lifeline, lifeline to be repositionably (for example, in a sliding fashion) moved along the lifeline, if desired. This may be achieved by removably attaching a user's harness element (a rope grab, carabiner, snap hook, ring or similar device, for example) to the lifeline, such as to allow this harness element to slidingly move along and over the lifeline, to substantially any location of the lifeline, between the attachment of the lifeline to the tether line, common tether line or support line while optionally avoiding a fixation of the lifeline element at any predetermined location, if preferred, or anchoring to any location along such line.

The term "exemplary" when used herein is defined to mean "serving as an example, instance, or illustration." Accordingly, any embodiment referred to as "exemplary" is not to be construed as preferred or advantageous over other embodiments.

Figure 1:
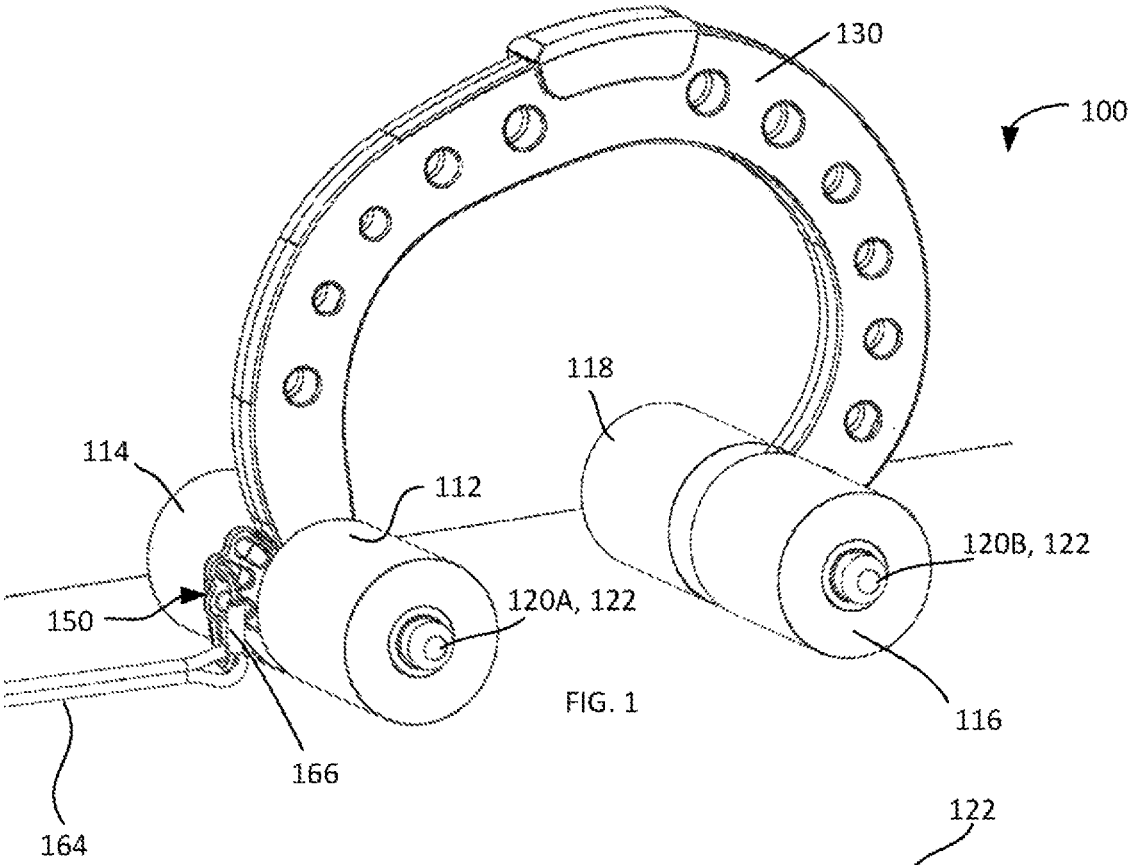
FIG. 1 is a perspective view of an improved wheeled roof-anchor or an "eave hook" system featuring a connector that is pivotally attached to an axle.
Figure 2:
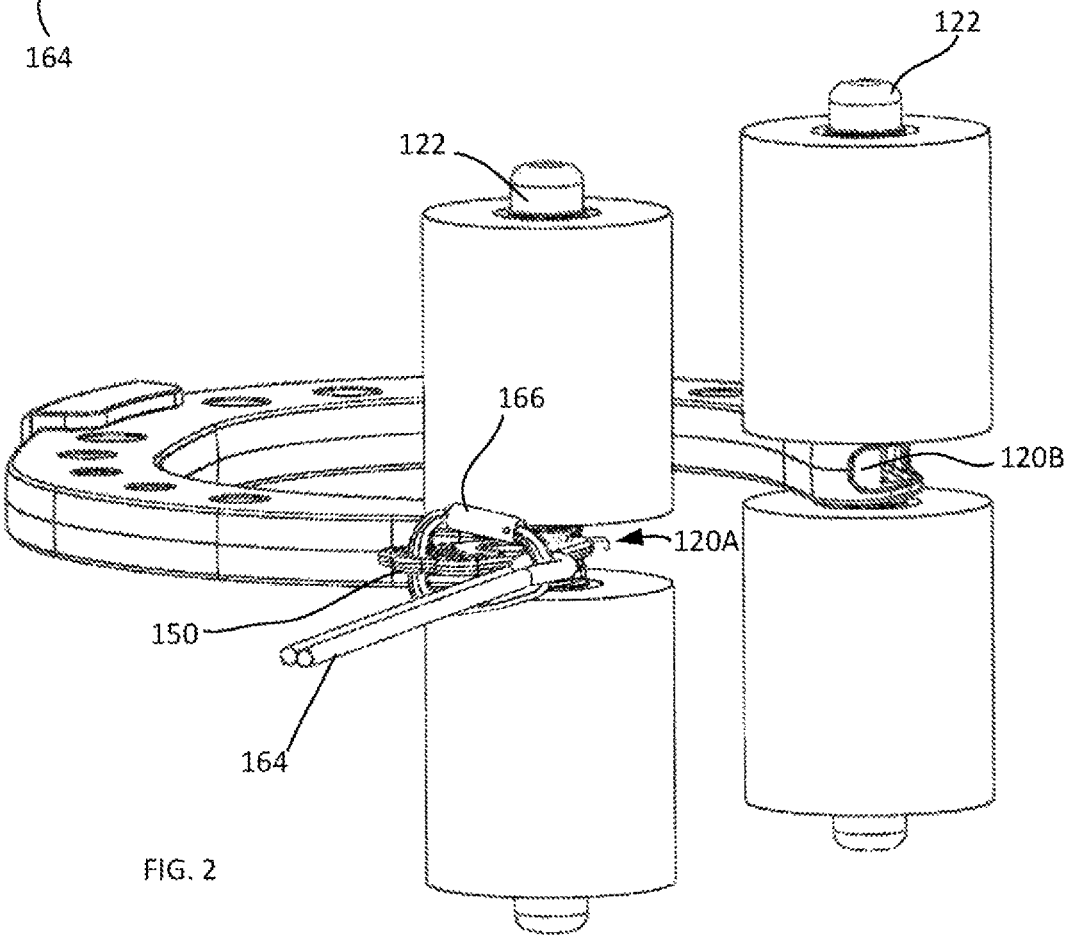
FIG. 2 is a bottom perspective view of the embodiment of FIG. 1.

To this end, FIGS. 1 and 2 illustrate an embodiment of a mobile "eave hook" device or anchor 100, shown in this example as having four wheels 112, 114, 116 and 118, arranged in two pairs on respectively-corresponding axles. (Depending on the specifics of a particular implementation, a different number of wheels can be employed.) The wheels can generally be made of any desired materials such as rubber or plastic, for example, and may also have a surface configured to be slide-resistant.

Wheel axles 120A and 120B in one case can be capped with caps 122 and interconnected with one another through an arched anchor or lever or anchor body 130 that extends continuously from the axle 120A to the axle 120B, forming an open hook used for engaging a roof projection (for example, a roof eave) as discussed below. The arched anchor or hook 130 may be constructed of any relatively strong material such as steel, for example, and preferably dimensioned to form a generally asymmetrical "C" (with the curvature of the body 130 at one end being different from that at the other end). For example, as shown in FIG. 1, the end of arched anchor or hook 130 that attaches to wheel axle 120B is more curved than the end attached to the wheel axle 120A.

Figure 3:
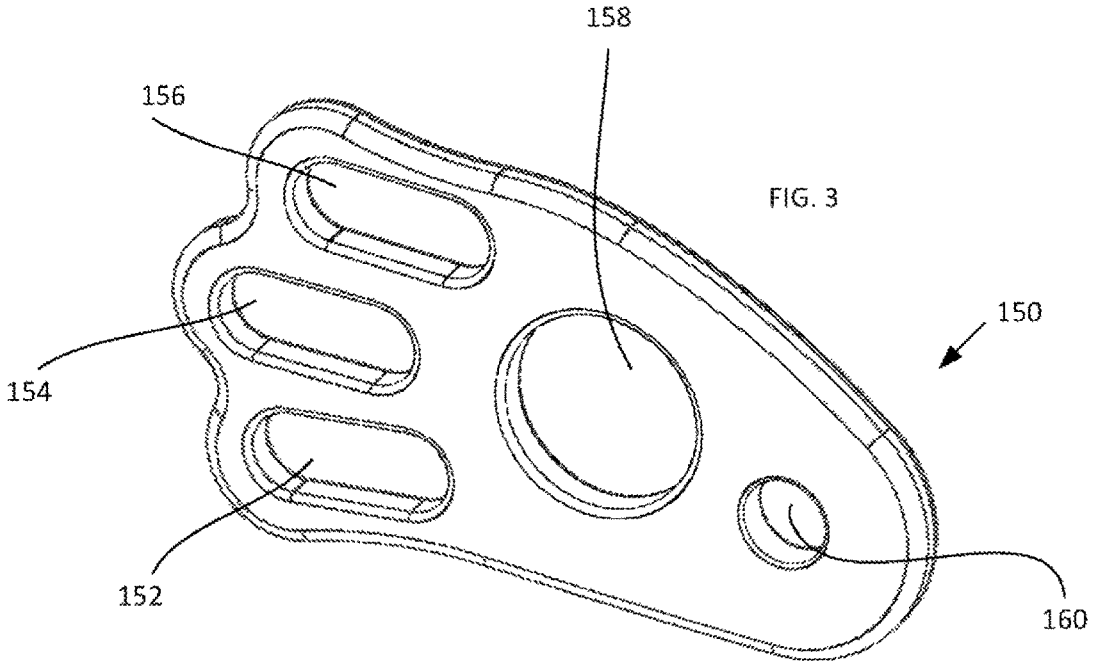
FIG. 3 is a perspective view of the embodiment of the connector depicted in FIGS. 1 and 2.

Now in reference to FIGS. 1, 2, and 3, the embodiment of the anchoring device is equipped with a connector 150 (which is including multiple through openings 152, 154, 156, 158, 160) that is pivotally attached to an axle (as shown—to axle 120A) through and at one of the openings of the connector 150—to which a tether 164 (a strap, a rope, a rod, a cord, a chain, for example) or another connector or different device may be attached directly or indirectly, and preferably to the opening that is closest to the roof when installed.

As shown in FIGS. 1 and 2, the tether 164 may be optionally removably coupled with the connector 150 of the anchoring member 100 via at least one snap hook, carabiner, tensioner, or similar intermediate link/s 166 (which is then in turn optionally removably connected to the pivotally attached connector 150. However, it may also be desirable to couple the tether 164 directly to the connector 150 without the use of intermediary link(s). Analysis of practical use and operation of the embodiment 100 for the purposes of securing a user on the roof has shown that utilizing the connector 150 pivotally-attached to and on the axle 120A in conjunction with the tether 164 or the combination of the tether 164 with the intermediate link 166 removes the risk of pulling or otherwise dislodging the device 100 anchored to the roof, away from the location at which the device 100 is attached to an eave or similar structure, as a result of a sudden and moderate to large force applied to an attachment of the tether to the body of the anchoring device, above the set of wheels that are sitting on the rooftop within an installed anchoring system where the wheels that are below the soffit are hanging a few inches below the soffit, as a result of improper installation, relaxing of the ropes without proper maintenance or other reasons. At on-site testing of a design currently used in related art, a wheeled anchor, as described above, was detached several times by a person, standing on the roof, pulling the tether upwards at an angle similar to a 14:12 slope in the direction of a force that would be caused by a fall from a person attached to the system on the opposite side of the roof Understandably, eliminating this risk is critically important for the practical use of the roof anchor, as a fall from the roof may cause at a minimum serious injuries.

Figure 6:
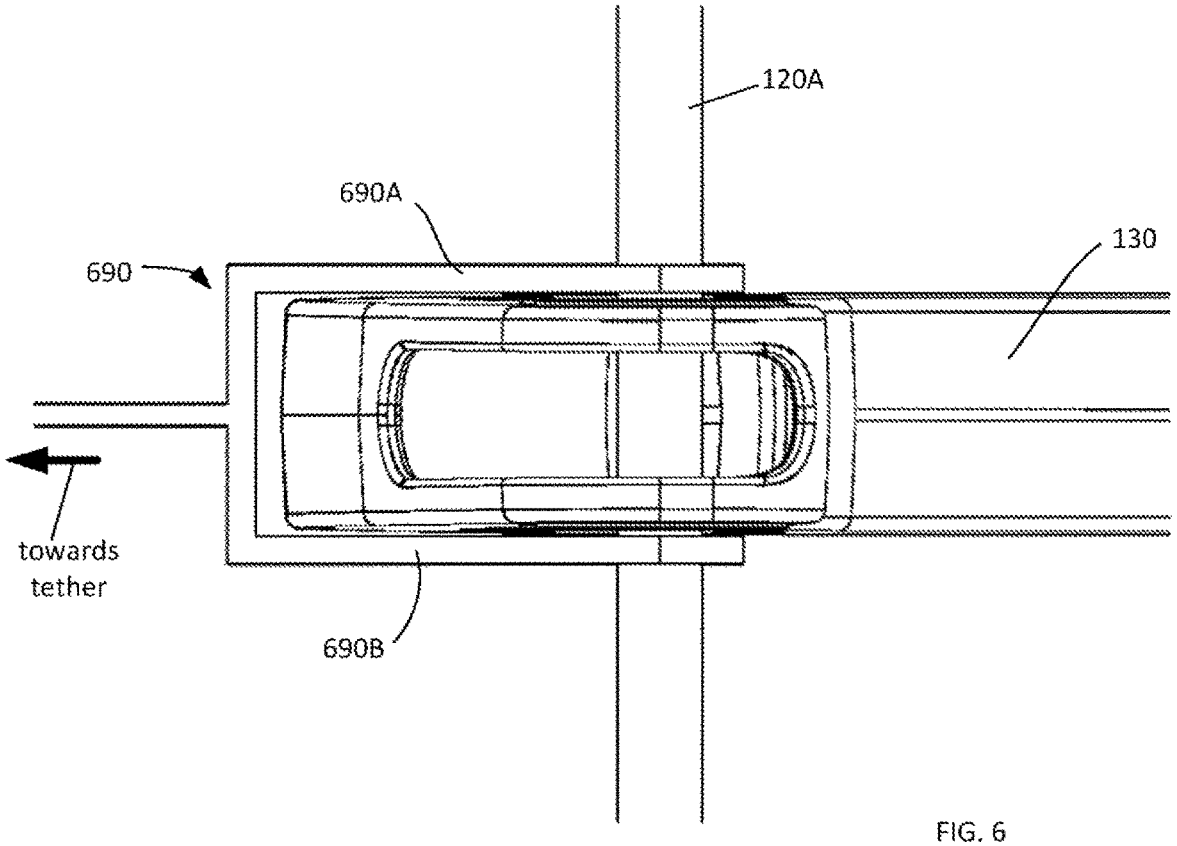
FIG. 6 provides a bottom view of a related embodiment of a connector of the roof-anchoring device, that is attached to an axle of the anchoring member in two places (for clarity, the wheels are not shown on the axle in FIG. 6)

(In a related implementation of the connector configured to be pivotally attached to the axle of the device 100—such as that of the connector 690 schematically illustrated in FIG. 6 in cooperation with the axle 120A—the connector 690 is judiciously configured to be a bracket with two arms 690A, 690B. Such bracket is dimensioned to embrace and go around the end of the anchoring device body 130, (shown attached to the axle 120A) to be movably affixed to the axle 120A in two places, through two respective openings in the arms 690A, 690B. The specific shape and features of the embodiment of the connector (intermediate link) 690 may differ—for example, the connector can include more than two openings for attachment to an axle (as would be, for example, in the case when the connector is configured to have an "M" shape for attachment to the axle at three locations).

As shown in the example of FIG. 3, the connector 150 may include a plurality of openings that facilitate attachment to other auxiliary connectors, tethers, and devices that may be used in conjunction therewith.

Figure 4A:
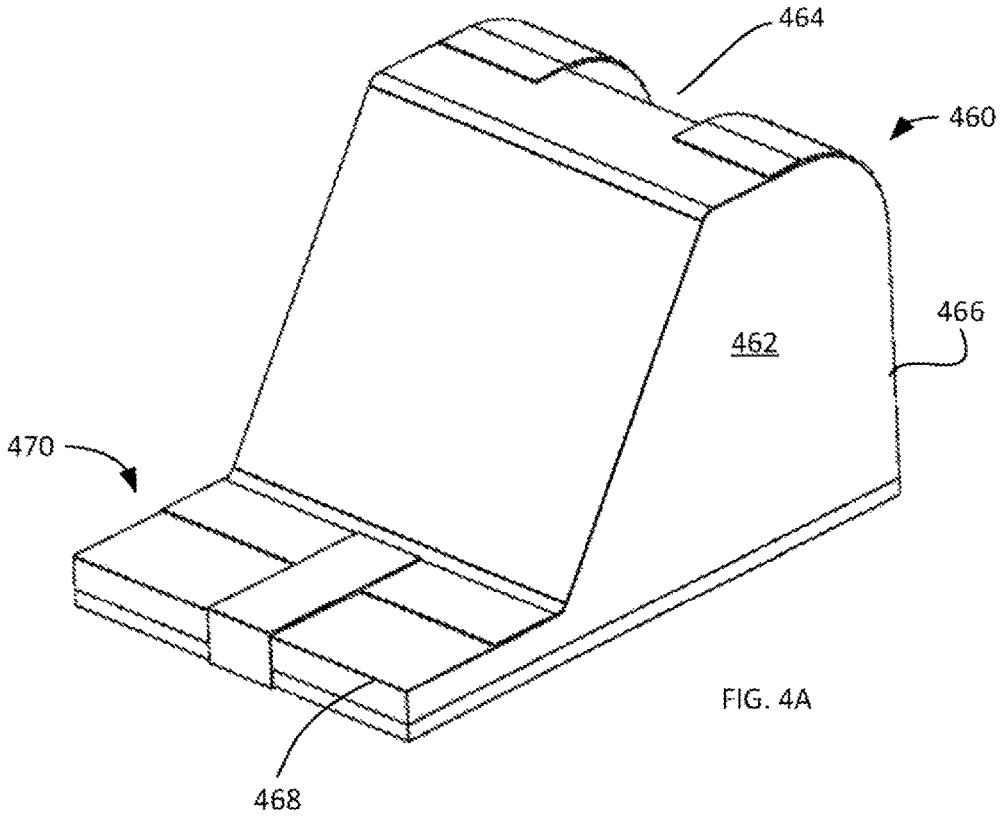
FIGS. 4A and 4B are perspective views of a stop member, used in cooperation with a roof-anchoring device such as that depicted in FIGS. 1 and 2.
Figure 4B:
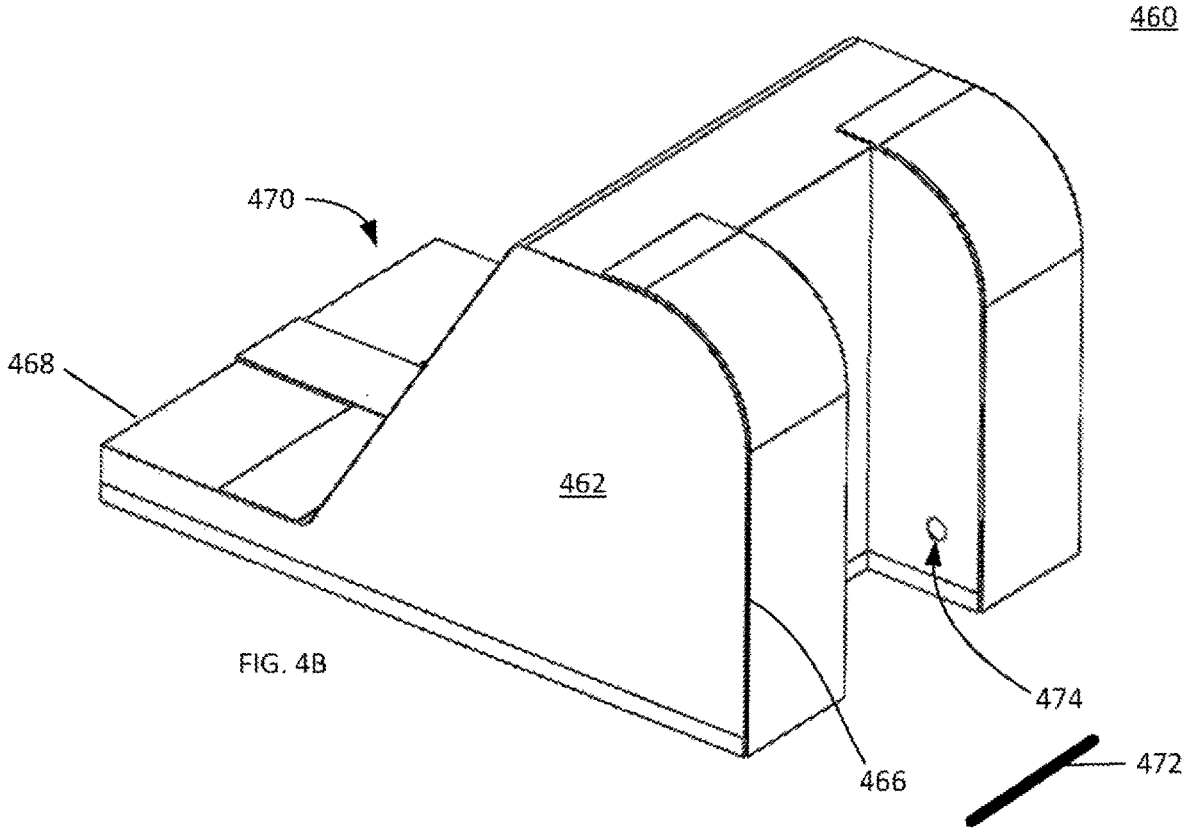

Additional embodiments of the improved roof-anchoring system may include a stopper 460, as shown in FIG. 4, to keep a wheeled roof anchoring system 100 in place on the roof during the deployment or installation thereof. As shown in FIGS. 4A and 4B, the stopper 460 may feature a generally trapezoidal or wedge-shaped portion, 462, to wedge between the wheels of the anchoring device and the surface of the roof to prevent the mobile device from descending or rolling down the roof, in operation thereof. The stopper 460 further may feature a notch or trench 464 on a first end 466 of the stopper, and a planar or other appropriately shaped protrusion 470 at a second end 468 of the stopper, upon which the wheels of the wheeled anchor 100 may sit. In addition, a rod 472 may be used for insertion into the opening(s) 474 of the stopper, or otherwise be attached to the stopper with, for example, a clamp, and used as a handle or connection point for a tether, carabiner, snap hook or another appropriate device and/or to add counterweight (e.g., if a steel rod is used) with the use of which the stopper will be removed to free the wheels of the anchoring device. This allows a user to safely remove the stop (e.g., the user can remove the stopper while standing on the ground, next to the building).

FIGS. SA and SB depict the use of an embodiment 460 of the stopper with an anchor 100. As shown in FIG. SA, when the anchor or anchoring member 100 is lowered away from the summit of the roof along the slope of the roof 510 towards the edge 514, the stopper 460 is used (substantially, as a wedge element) to optionally temporarily stop the anchor 100 in a desired location before the lower wheels 116, 118 of the anchor 100 reach the edge 114. FIG. SB illustrates the moment of "release" of the anchor 100 by, for example, pulling the tether 164 towards the summit of the roof to separate the wheels 116, 118 from contact with the stopper (and-when the stopper 460 is substantially at the edge 514 of the roof-let the stopper 460 fall from the roof). Following the release of the stopper 460 from the anchor 100 (FIG. SC), the anchor 100 can be further lowered along the surface 510 towards the edge/eave/other structure of the roof until the lower wheels 116, 118 assume the position below the edge or eave (FIG. SD), to position the anchoring member 100 firmly pressed to the eave/edge and under the eave/edge, as discussed in more detail below. (While the tether is shown in FIGS. SA, SB to be attached to the upper through-hole of the connector 150, it is understood that in some implementations it is preferred to have it attached to the lower through-hole, as is schematically shown in FIG. SC.)

In further reference to FIGS. 1 and 2, in one implementation of the use of the anchoring device 100, after a user (not pictured) ensures that the anchoring device 100 is securely affixed to the tether line 164 (via, for example, the connector 150), the anchoring device 100 is placed on the slope of the roof to have all sets of its wheels in contact with the rooftop (FIG. SC) and further lowered down a roof slope in a direction away from a roof ridge or peak or summit (not pictured) towards the roof edge. As the wheeled anchoring member 100 reaches the roof edge, the leading wheels 116 and 118 (located at a lower level on the roof as compared to the wheels 112, 114) drop below the roof edge (FIG. SD). The anchoring device is then slightly raised by its tether so that the leading wheels of the anchoring device 100 that are below the roof edge are raised up and engage the soffit or under-roof surface (FIG. SE) with the wheels 116, 118. In other words, the anchoring device 100 is further tensioned (strained) against and in contact with the roof edge as a result of pulling the anchoring device towards the roof summit so as to draw the device tightly into place, while the trailing wheels 112, 114 (at the tethered axle 120A) remain on the roof surface above the lower wheels 116, 118 now affixed in a tensioned position under the roof edge.

Figure 7A:
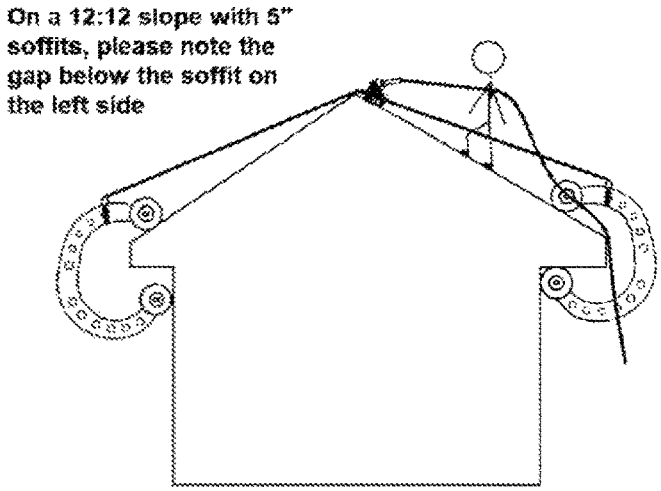
FIGS. 7A, 7B, 7C show an example of operational deficiency of using an anchoring device of related art with a tether attached to the arched body of the device (instead of the connector, as per the idea of the invention). A large force, suddenly applied to the anchoring device through the attached tether or a connector and a tether to the arched body—as might be expected when a user of the anchoring device attached to eave of the roof on the side of the house opposite to a part of the roof where the user is standing— creates a non-zero torque shown to cause the anchoring device to detach from the eave and make the user lose support on the roof.
Figure 7B:
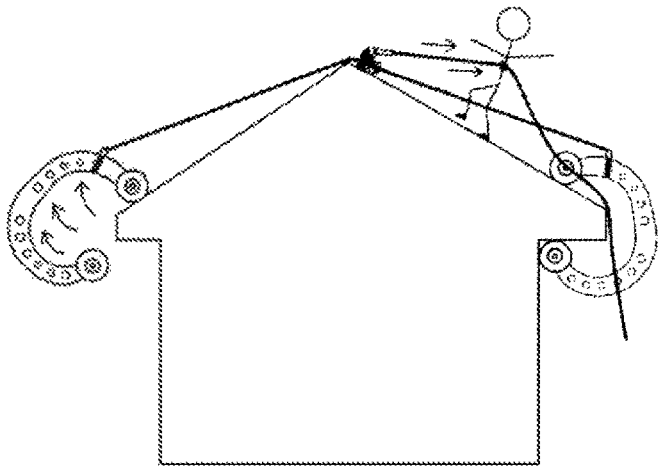
Figure 7C:
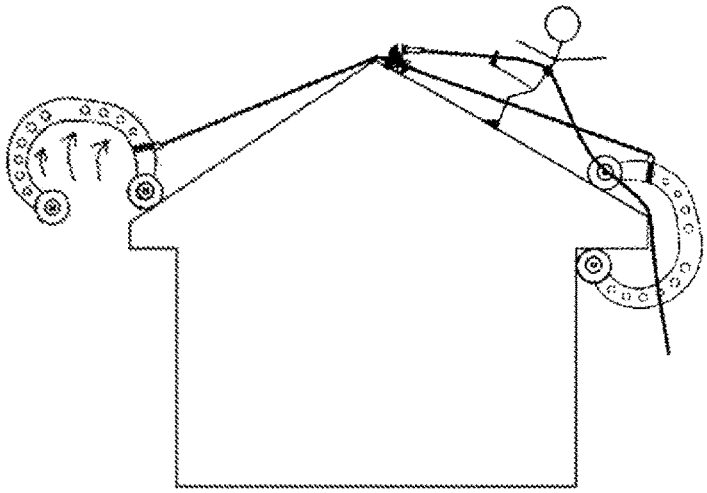

When used with the "stopper", a procedure of installation of the anchoring device may involve the steps of positioning a wheeled anchoring device 100 on the roof near the roof edge, with the leading wheels 116 and 118 resting upon or otherwise engaging the stopper. When the user is ready to install the device 100, wheels 116 and 118 are released or disengaged from the stopper 460, to preferably cause the stopper to fall. (A small auxiliary tether may be attached to the rod at the back of the stopper and also attached to the side of a ladder to catch the stopper, causing it to not fall to the ground.) Then, the leading wheels 116 and 118 of the device 100 may be lowered by the tether 164 and dropped below the roof edge such that the leading wheels of the anchoring device 100 hang below the roof edge to engage a soffit or under-roof surface (not pictured) with the wheels 116, 118 and further secured in the so-engaged position by pulling the tether 164 up the roof and securing the tether in a position in which the wheels 116, 118 are in tensioned contact with a surface under the edge of the roof FIGS. 7A, 7B, 7C illustrate schematically an example of an anchoring device and a single tether that is attached to the body of the anchoring device, rather than the axle via the pivotal connector 150 of an embodiment of the invention. (While the tether line is illustrated to be attached at its end to the body of the anchoring device, generally it shall be attached to the corresponding pivotal connector.) A moderate to large force, suddenly applied to the anchoring device through the attached tether or a connector and a tether—as might be expected when a user of the anchoring device (attached to eave of the roof on the side of the house opposite to a part of the roof where the user is standing) stumbles or falls, creates a non-zero torque due to the non-zero spatial separation between the point of attachment of the tether and the axle of the anchoring device. This non-zero torque may separate/detach the anchoring device (on the left side of FIGS. 7A, 7B, 7C). The attachment of the tether to the pivotable connector and through it—to the axle of the anchoring device, according to the idea of the invention, avoids such possibility.

In practice, the method of forming and maintaining a secure attachment to a roof of the building includes the simultaneous use of a combination of multiple anchoring devices used simultaneously (at least two, possibly three or more—each may be structured according to the embodiment 100 or configured to substantially resemble it). This situation is schematically illustrated in FIG. 8A, showing (from the top) the second anchoring device 810 already secured with one axle and set of wheels under the edge 820A of the roof slope 820 and the first anchoring device 830 already secured with one axle of that system under another edge 840A of another, opposite roof slope 840. The single individual tether, labeled as 810A on one side and 830A on the other side, attached to the respectively-corresponding devices 810, 830 via corresponding connectors pivotally affixed to the front (upper) axles of the devices 810, 830—is stretched along the respectively-corresponding slopes 820, 840 and tensioned (with the use of a progress capture pulley, ratchet, or other tightening device 186) at the device 810 and/or the device 830. (Alternatively, 810A and 830A may be two separate tethers that are attached to the respectively-corresponding anchoring devices 810, 830 via corresponding connectors pivotally affixed to the front/upper axles of the devices 810, 830—are stretched along the respectively-corresponding slopes 820, 840 and then attached to one another with the use of a ratchet 186, for example to form a common tether line extending from the device 810 to the device 830.) This tether line is formed under tension sufficient to maintain each of the devices 810, 830 in their respective positions without having the devices substantially moving away from the respective edges with respect to the edges 820A, 840A even if a sufficient force were to be applied to at least one of the devices 810, 830. (As shown, the single tether line 810A, 830A or common tether line formed by individual tethers 810A, 830A is passed over the multiple rooftop edges—shown in this example as A, B, C, D, E—while not being attached to any other roof fixture). The so-attached/interconnected and stretched about the roof combination of the first and second anchors 810, 830 is configured, therefore, to allow the user 860 to movably affix himself, with the use of appropriate gear and harness—such as that including a rope grab, carabiner, snap hook, ring or other similar device—to the common tether line 810A, 830A to be able to slidably reposition such rope grab, carabiner, snap hook, ring, or other similar device over and along the single or common tether line 810A, 830A from substantially every point of the single or common tether line to every other point of the common tether line and, therefore, to move about the roof while being secured from the fall by the systems 810, 830 interconnected to one another by the strained single or common tether line 810A,830A.

As illustrated in the specific example FIG. 8A, for example, the lifeline 870 passing through and/or attached to the belt or harness of the user 860 is slidably attached via some combination of a lanyard, lifeline, strap or other type of line and a slidable device/s such as a rope grab, carabiner, snap hook, ring or other similar device 866 to the common tether 810A, 830A at the lifeline to the tether or the harness to the lifeline. Alternatively, in a related embodiment, the attachments 866 may be sufficiently fixed.

A person of skill will readily appreciate that formation of the common tether line as discussed results in a situation where the used anchoring device 830 is prevented from moving away from the corresponding edges of the roof by the tensioned contact of the anchoring device 810 with the edge 820A of the roof, while the anchoring device 810 is prevented from moving away from the edge 820A of the roof by the tensioned contact of the anchoring device 830 with the edge 840A of the roof Furthermore, the user 860 is enabled to move about the roof while connected to the tether line or common tether line via the device 866. Notably, with only one lifeline attached to one tether, if a user moves too close to a corner such person is at risk of falling because he/she can only be completely prevented from falling off of 1 of the 2 edges that are on either side of the corner. However, if a person anchors one lifeline to the tether, at or near the anchoring device that is closest to the corner, and anchors a second lifeline to the same tether line or common tether line at a distance away from the anchorage of the first lifeline, the person can be protected from falling from the roof edges on both sides of the corner so they can get much closer to the corner with fall protection. FIG. 8B schematically illustrates a secure attachment to the roof similar to that of FIG. 8A, but in which a person is using two lifelines instead of one, to better prevent a fall while working near a corner.

As an additional illustration, the schematic version of the combination of the already connected to one another systems 810, 830 is shown in FIGS. 9A, 9B where the arrows 910, 920 illustrate the tension force(s) with which the lower set of wheels with corresponding axles of the systems 810, 830 are substantially unmovably pressed to the undersurface of the roof below the corresponding edges 820A, 840A, with the tether tensioned and attached to the anchoring devices.

Notably, certain further improvements to the methodology for forming and maintaining a secure attachment to the roof are envisioned and remain within the scope of the invention. Among them—in reference to FIG. 10A, for example, showing schematically a top view of the roof with edges 1010, 1014, 1018, 1022—there is the use of a system in which, in addition to the tether line 1030 tensionably connecting the opposing anchoring devices 1034, 1038 that are substantially immovably affixed to and under the edges 1010, 1014 (as discussed above), at least one additional anchoring device is used (as shown—two devices, 1042 and 1046) that, with the use of its respective tether or support line (or lifeline; here—1050, 1054) is also affixed under tension to the roof edge (1018, 1022) and substantially permanently to the major tether line 1030 at a point between the ends of the tether line (here—points 1060, 1064) such that the corresponding support line and the main, common tether line are transverse to one another. In a specific example, the attachment between a given support line and a tether line 1030 can be structured with the use of a component referred to in the art as a "Goblin". A Goblin is a certified rope access back up device that allows for both sliding and anchor on a connected line, such as a tether line, a support line, or a lifeline and also allows for a fixed connection to another device, such as a carabiner, lifeline lanyard, or harness. When two or more so-structured connecting lines (1050, 1054) are present, the connecting points 1060, 1064 can be chosen far apart from one another (substantially anywhere between the ends of the tether 1030 corresponding to the anchors 1034, 1038) or close to one another (as shown). (As shown, with two tensioned tethers from the tether line 1030 to the anchor device 1042, and the tether line 1030 to the anchor device 1046, the tether line 1050 is much stronger and the person 860 is better protected than if the tether line 1030 to 1046 was not included.)

This additional arrangement of the combination of the main tether line with at least one support line facilitates an additional degree of freedom as far as attachment of the user at the rooftop is concerned. Specifically, the user 860 located on the roof somewhere in the area limited by the edges 1014, 1018 and the support line 1050 and the tether line 1030 is now in a position to use a predefined connecting element to moveably affix the harness the user is wearing to both the support line and the tether line—thereby gaining the ability to move anywhere in the identified area and approach the corner of the roof at the intersection of edges 1014, 1018 without the risk of falling off the roof Alternatively or in addition, at least one of the mechanical connections between the user's harness and the lines 1030, 1050 (in this example) can be an anchored—that is, substantially immovable-connection.

Added tethers from auxiliary anchoring devices may be used to increase the safe area on the roof for the user and reinforce the existing tensioned tether line/s. (For example, to reinforce a tensioned line, a person with a 200-foot tensioned tether line, halfway between the two anchoring devices may attach a second tensioned tether to the original tether, such second tether line is attached preferably substantially perpendicularly to the original tensioned tether line and attaches to an anchorage at the roof edge, where the roof edge is nearly parallel to the original tether. This tether reinforces the original tether for a person that is attached to the original tether and is on the roof on the opposite side of the roof from the second auxiliary tether. To reinforce the original tensioned tether on both sides of the roof, a tensioned tether shall be attached to both sides of the original tether.

Figure 5A:
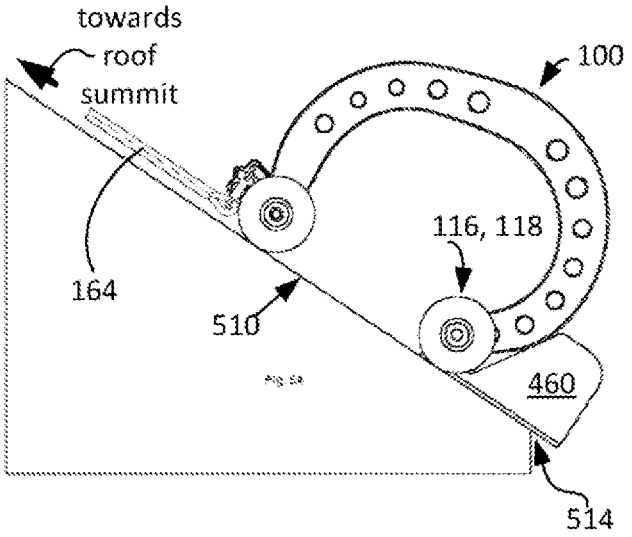
Figure 5B:
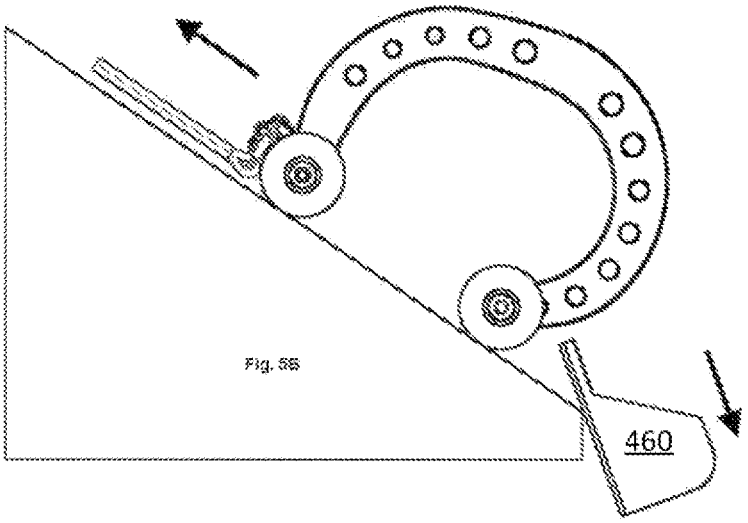
FIG. 5B illustrates a situation in which the stopper member is separating from the embodiment of the anchoring device.
Figure 5C:
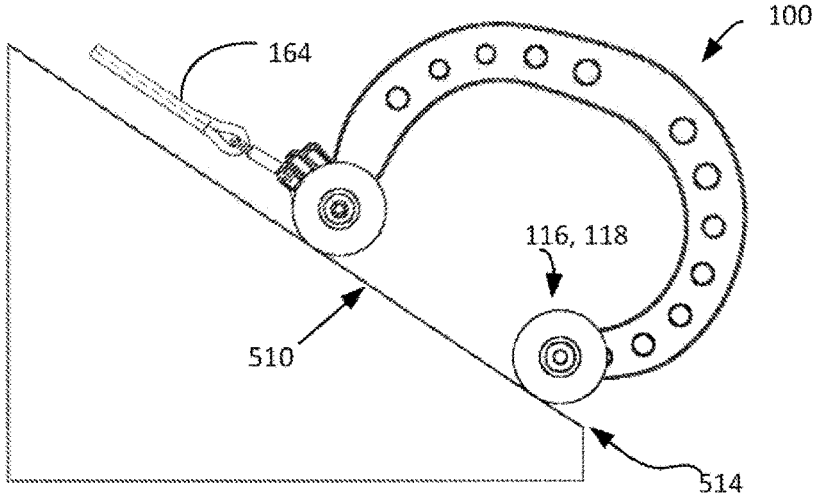
FIGS. 5C, 5D, 5E illustrate additional and/or related steps of tensioned attachment of the anchoring device in cooperation with the roof edge.
Figure 5D:
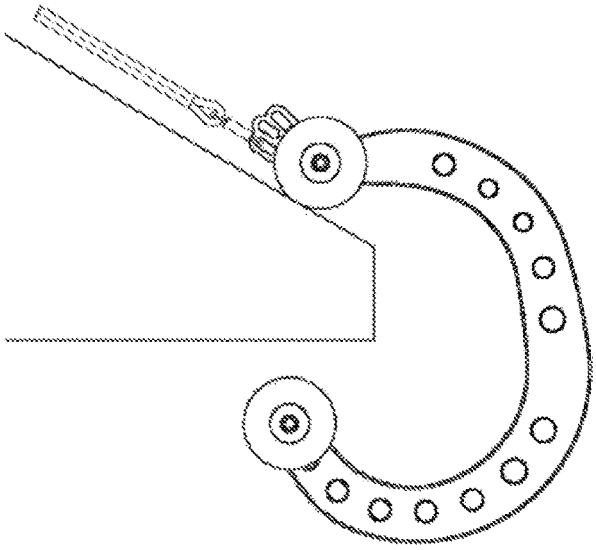
Figure 5E:
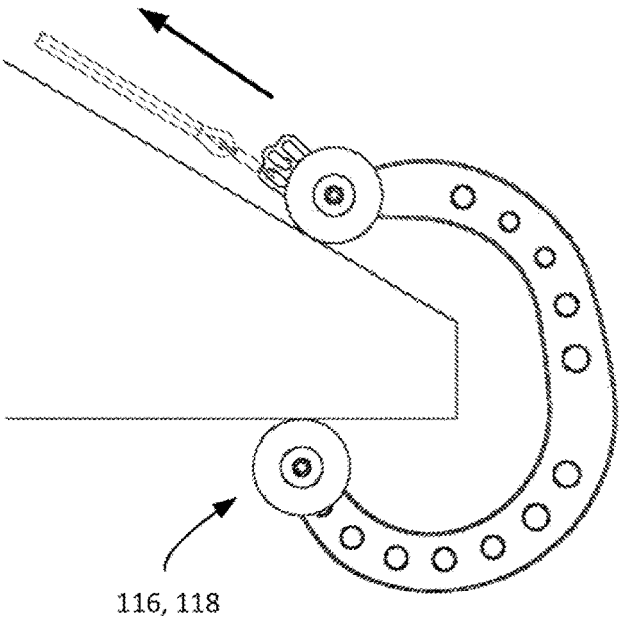

Yet another related non-limiting implementation is schematically shown in FIG. 10B, in which two anchoring devices 1070A, 1070B juxtaposed in cooperation with the same roof edge 1018 are tensioned (via two tethers 1074A, 1074B) against the anchoring device 1078 juxtaposed in cooperation with the opposite roof edge 1022. 1080A, 1080B illustrate back-up safety ropes and/or ropes for ascending/descending along the roof Accordingly, referring to FIGS. 11-20, an embodiment of the method for installation of a roof anchor on a roof of a building may include attaching a tether 164 to the front of a first anchoring device 100, 830 and running the tether 164 across the roof, possibly with the assistance of a line thrower 180 and throw line 182 connected at one end to the tether, lifting the anchor device, possibly with a ladder 34 (as shown in FIGS. 12 and 20), and positioning a first wheeled roof-anchoring device 100, 830 near a first edge of the roof (as shown in FIG. 14). The first roof-anchoring device 100, 830 includes a first arched body having first and second ends, the first axle with the first set of wheels juxtaposed with the first arched body at the first end, the second axle with the second set of wheels juxtaposed with the first arched body at the second end, and the first connector 150. The first connector is connected to the tether line 164 via a carabiner or intermediate link 166 (as shown in FIG. 1). The first wheeled roof anchoring device 100, 830 is positioned near the first edge of the roof as shown in FIG. 14 such that a first set of wheels with a corresponding first set of wheels with corresponding axle are located under and in a first tensioned contact with the first edge while a second set of wheels 112, 114 with a corresponding second axle are in contact with and on the roof and a first connector 150 pivotally attached to the second axle is under tension due to a first force pulling the first connector 150 away from the second axle up the roof via tether line 164, possibly from a second user/person on the opposite side of the roof that is pulling the tether line 164 that is coming from the anchor device. When a second user/person is not available to pull on tether line 164, then the first roof anchoring device 100, 830 may be temporarily placed on the roof with a stopper as shown in FIG. 5A and as previously discussed. Throw line 182 has a weight or weighted bag 184 on an end opposite of that connected to the tether to aid in getting the throw line and the tether across the roof. As will be understood by those of ordinary skill in the art, the line thrower 180 may be used while a user/person 32 is positioned on the ground (as shown in FIG. 11) or on a ladder 34 (as shown in FIGS. 12 and 20). The method additionally includes disposing a second wheeled roof-anchoring device near a second edge of the roof, generally on the opposite side of the roof from the first edge, such that a third set of wheels with a corresponding third axle are located under and in a second tensioned contact with the second edge while a fourth set of wheels with a corresponding fourth axle are in contact with and on the roof and a second connector pivotally attached to the fourth axle is under tension due to a second force pulling the second connector away from the fourth axle, up the roof. As shown in FIGS. 15-17, this may be done by suspending the second anchor device 100-2/810 below the second roof edge, slightly above the ground, from the tensioned tether line 164 that is coming from the first anchor device using a progress capture pulley or similar tensioning device 186, and then lifting the anchor device with the tether line 164 and progress capture pulley or similar tensioning device 186, maintaining tension on the tether to the first anchor device on the other side, and then disposing the second anchoring device on the edge E' of the second roof edge and tensioning the tether line. User 32 is on a ladder 34 and wearing a harness 176 and a lanyard 174 that is connected to a rope grab 178 with a carabiner. Rope grab 178 is slidably connected to tether line 164. Tether line 164 is looped through a progress capture pulley or similar tensioning device 186 that is connected to connector 150 on second anchor device 100-2/810. Progress capture pulley or similar tensioning device 186 may be connected to a carabiner 166 that is connected through an aperture on connector 150. See the schematic illustrations of FIGS. 9A, 9B. (Here such second roof-anchoring device includes a second arched body having third and fourth ends, the third axle with the third set of wheels juxtaposed with the second arched body at the third end, the fourth axle with the fourth set of wheels juxtaposed with the second arched body at the fourth end, and the second connector). The first and second connectors are interconnected under constant tension with a common tether line to maintain the first and second tensioned contacts while preventing the first and third sets of wheels from losing contact with respective first and second edges of the roof It should be evident that the improved roof-anchoring device 100, the overall anchoring system (such as that described in reference to FIG. 8A, 8B or FIGS. 9A, 9B, for example) and any components disclosed herein may be fabricated or formed in a variety of ways and from a variety of materials. The various parts may be machined, molded or otherwise fabricated from high strength materials such as steel, aluminum alloy, reinforced aluminum, tubular alloy, high-strength plastics or wood, or be manufactured from a combination of any suitable materials and processes. The choice of materials and construction are clearly within the scope of the appended claims. A skilled artisan will readily appreciate that embodiments of the invention—as illustrated, for example, in connection with FIG. 8A—provide a clear advantage in exploitation of the embodiment. Specifically, neither the safety feature described in connection with FIG. 8A nor the situation when the hook or ring 866 is repositionable substantially from every point on the common tether line to every other point of the common tether line, understandably, is not possible when a link connecting the devices 810, 830 to one another includes an element that is in contact with the roof under pressure vector directed towards the roof to provide a firm hold at the roof: in this latter case, such element acts to additionally restrict or prevent the movement of a given slidable device 866 with respect to the corresponding edge.)

References made throughout this specification to "one embodiment," "an embodiment," "a related embodiment," or similar language mean that a particular feature, structure, or characteristic described in connection with the referred to "embodiment" is included in at least one embodiment of the present invention. Thus, appearances of these phrases and terms may, but do not necessarily, refer to the same implementation. It is to be understood that no portion of disclosure, taken on its own and in possible connection with a figure, is intended to provide a complete description of all features of the invention.

It is also to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, for purposes of simplifying the given drawing and discussion, and to direct the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this detail in the drawing may be implied unless the context of the description requires otherwise. In other instances, well known structures, details, materials, or operations may be not shown in a given drawing or described in detail to avoid obscuring aspects of an embodiment of the invention that are being discussed.

The invention as recited in claims appended to this disclosure is intended to be assessed in light of the disclosure as a whole, including features disclosed in prior art to which reference is made.

While the description of the invention is presented through the above examples of embodiments, those of ordinary skill in the art understand that modifications to, and variations of, the illustrated embodiments may be made without departing from the inventive concepts disclosed herein. The invention should not be viewed as being limited to the disclosed examples.

I claim:

1. A method for restraining and/or arresting falls from a roof on a structure, the roof comprising at least one sloped surface, the method comprising:

(1) installing a non-penetrating fall protection system on the roof, the non-penetrating fall protection system comprising:

(a) a plurality of anchoring devices each comprising an arched body having a front end and a rear end and configured to hook around an edge of the roof, wherein the plurality of anchoring devices comprises a first anchoring device configured to hook around a first edge of the roof and a second anchoring device configured to hook around a second edge of the roof;

(b) a single tether line configured to be connected under tension between the first anchoring device and the second anchoring device and extending over the at least one sloped surface of the roof, the single tether line configured to hold the first anchoring device around the first edge and to hold the second anchoring device around the second edge;

(c) a first lifeline configured to be connected to the single tether line at a first end of the first lifeline; and (d) a tether line slidable element comprising a rope grab configured to be connected to the first end of the first lifeline and configured to selectively and repositionably anchor the first end of the first lifeline to the single tether line at a selected one of a plurality of tether line anchor points disposed between the first anchoring device and the second anchoring device by (1) freely allowing slidable movement of the first end of the first lifeline along the single tether line in a first direction and (2) anchoring the first end of the first lifeline to the single tether line at the selected one of the plurality of tether line anchor points by not allowing slidable movement of the first end of the first lifeline in a second direction substantially reversed from the first direction unless the tether line slidable element is actuated to allow slidable movement in the second direction;

(e) a first user slidable element comprising a rope grab configured to be connected to the first lifeline and to a user device and configured to selectively and repositionably anchor the user device to the first lifeline at a selected one of a plurality of first lifeline anchor points disposed between the first end of the first lifeline and a second end of the first lifeline by (1) freely allowing slidable movement of the first user slidable element along the first lifeline in a third direction and (2) anchoring the first user slidable element to the first lifeline at the selected one of the plurality of first lifeline anchor points by not allowing slidable movement of the first user slidable element in a fourth direction substantially reversed from the third direction unless the first user slidable element is actuated to allow slidable movement in the fourth direction, wherein the user device comprises one or more of a harness or a lanyard or a combination thereof:

wherein the installing of the first anchoring device, the second anchoring device, and the single tether line do not require a user to be on the roof;

(2) attaching the first user slidable element to the first lifeline;

(3) attaching the user device to the first user slidable element;

(4) attaching the tether line slidable element to the single tether line;

(5) attaching the first end of the first lifeline to the tether line slidable element;

(6) sliding the tether line slidable element along the single tether line and anchoring at a selected first of the plurality of tether line anchor points to prevent motion of the first end of the first lifeline along the single tether line in the second direction; and (7) sliding the first user slidable element along the first lifeline and anchoring at a selected first of the plurality of first lifeline anchor points to prevent motion of the first user slidable element along the first lifeline in the fourth direction.

2. The method of claim 1, wherein the roof comprises at least two sloped surfaces forming a peak and wherein the single tether line is configured to extend over and contact the peak.

3. The method of claim 2, wherein the attaching the tether line slidable element to the single tether line comprises orienting the tether line slidable element on the single tether line so that the first direction is towards the peak.

4. The method of claim 3, wherein the selected first one of the plurality tether line anchor points and the selected first one of the plurality of first lifeline anchor points define a desired work location on the roof;

wherein the user device can reach the desired work location without risk of sliding in the fourth direction beyond the desired work location because the first user slidable element is anchored to the first lifeline and will not allow further sliding in the fourth direction, and without risk of sliding in the second direction beyond the desired work location because the tether line slidable element is anchored to the single tether line and will not allow further sliding in the second direction.

5. The method of claim 3, wherein the attaching the user slidable to the lifeline comprises orienting the user slidable element on the lifeline line so that the first direction is towards the single tether line.

6. The method of claim 5, wherein a safe work area on the roof comprises an area that is (1) in the second direction relative to the selected first of the plurality of tether line anchor points and (2) in the fourth direction relative to the selected first of the plurality of first lifeline anchor points.

7. The method of claim 1, wherein no screws or nails secure the non-penetrating fall protection system to the roof.

8. The method of claim 1, wherein the installing further comprises placing the single tether line laterally across the roof with a throw line and a line thrower, wherein the throw line is connected to the single tether line.

9. The method of claim 1, wherein the installing further comprises:

positioning the single tether line across the roof with a first portion of the single tether line disposed on a first side of the structure near the first edge of the roof and a second portion of the single tether line disposed on a second side of the structure near the second edge of the roof, wherein the at least one sloped surface is disposed between the first edge and the second edge, and wherein the first edge is disposed substantially opposite from the second edge;

attaching the first portion of the single tether line to the first anchoring device;

lifting the first anchoring device to the first edge of the roof;

hooking the first anchoring device around the first edge of the roof;

attaching the second portion of the tether line to the second anchoring device;

lifting the second anchoring device to the second edge of the roof; and hooking the second anchoring device around the second edge of the roof.

10. The method of claim 9, wherein the installing further comprises:

connecting a tensioning device to the single tether line at or near the first anchoring device or the second anchoring device;

pulling the single tether line through the tensioning device to apply tension to the single tether line to hold the first anchoring device in position around the first edge of the roof and the second anchoring device in position around the second edge of the roof; and wherein the tensioning device operates as a progress capture pulley or a ratchet.

11. The method of claim 10, wherein when the installing is complete, the non-penetrating fall protection system is secured to the roof by only the single tether line connected under tension between the first anchoring device and the second anchoring device, the rear end of the first anchoring device being disposed in contact with a first eave at the first edge, and the rear end of the second anchoring device being disposed in contact with a second eave at the second edge.

12. The method of claim 9, wherein the first anchoring device further comprises a first connector pivotably connected to the first arched body near the first front end;

the second anchoring device further comprises a second connector pivotably connected to the second arched body near the second front end;

wherein attaching the first portion of the single tether line to the first anchoring device comprises connecting the first portion of the single tether line to the first connector; and wherein attaching the second portion of the single tether line to the second anchoring device comprises (1) connecting a tensioning device to the second connector with the tensioning device is positioned between the first anchoring device and the second anchoring device; (2) looping the second portion of the single tether line in the tensioning device with a free end of the second portion of the single tether line extending from the tensioning device.

13. The method of claim 12, wherein the lifting the second anchoring device comprises pulling on the free end of the second portion of the single tether line to raise the second anchoring device to the second edge; and wherein applying tension to the single tether line comprises pulling on the free end of the second portion of the single tether line after the positioning the second anchoring device is complete.

14. The method of claim 1, wherein the installing further comprises connecting a single tensioning device, configured to put the single tether line under tension, to the single tether line at or near the first anchoring device or the second anchoring device.

15. The method of claim 14, wherein the single tensioning device operates as a progress capture pulley or a ratchet.

16. The method of claim 1, wherein when the installing is complete, the non-penetrating fall protection system is secured to the roof by only the single tether line connected under tension between the first anchoring device and the second anchoring device, the rear end of the first anchoring device being disposed in contact with a first eave at the first edge, and the rear end of the second anchoring device being disposed in contact with a second eave at the second edge.

17. The method of claim 1, wherein the plurality of anchoring devices further comprises a third anchoring device configured to hook around a third roof edge;

wherein there are two of the tether line slidable elements, a first tether line slidable element and a second tether line slidable element;

wherein the non-penetrating fall protection system further comprises:

(f) a support line configured to be connected under tension between the single tether line and the third anchoring device;

wherein the attaching the tether line slidable element to the single tether line comprises attaching the first tether line slidable element and the second tether line slidable element to the single tether line;

wherein the attaching the first end of the first lifeline to the tether line slidable element comprises attaching the first end of the first lifeline to the first tether line slidable element;

wherein the method further comprises:

(8) attaching a first portion of the support line to the third anchoring device; and (9) attaching a second portion of the support line to the second tether line slidable element.

18. The method of claim 17 wherein the support line is substantially perpendicular to the single tether line.

19. The method of claim 17, wherein the non-penetrating fall protection system further comprises:

(g) a second lifeline configured to be connected to the support line at a first end of the second lifeline;

(h) a support line slidable element comprising a rope grab configured to be connected to the first end of the second lifeline and configured to selectively and repositionably anchor the first end of the second lifeline to the support line at a selected one of a plurality of support line anchor points disposed between the third anchoring device and the single tether line by (1) freely allowing slidable movement of the first end of the second lifeline along the support line in a fifth direction and (2) anchoring the first end of the second lifeline to the support line at the selected one of the plurality of support line anchor points by not allowing slidable movement of the first end of the second lifeline in a sixth direction substantially reversed from the fifth direction unless the support line slidable element is actuated to allow slidable movement in the sixth direction;

(i) a second user slidable element comprising a rope grab configured to be connected to the second lifeline and to the user device and configured to selectively and repositionably anchor the user device to the second lifeline at a selected one of a plurality of second lifeline anchor points disposed between the first end of the second lifeline and a second end of the second lifeline by (1) freely allowing slidable movement of the second user slidable element along the second lifeline in a seventh direction and (2) anchoring the second user slidable element to the second lifeline at the selected one of the plurality of second lifeline anchor points by not allowing slidable movement of the second user slidable element in an eighth direction substantially reversed from the seventh direction unless the second user slidable element is actuated to allow slidable movement in the eighth direction; and wherein the method further comprises:

(10) attaching the second user slidable element to the second lifeline;

(11) attaching the user device to the second user slidable element;

(12) attaching the support line slidable element to the support line;

(13) attaching the first end of the second lifeline to the support line slidable element:

(14) sliding the support line slidable element along the support line and anchoring at a selected first of the plurality of support line anchor points to prevent motion of the first end of the second lifeline along the support line in the sixth direction; and

(15) sliding the second user slidable element along the second lifeline and anchoring at a selected first of the plurality of second lifeline anchor points to prevent motion of the second user slidable element along the second lifeline in the eighth direction.

20. The method of claim 19 wherein the roof comprises at least two sloped surfaces forming a peak;

wherein the single tether line is configured to extend over and contact the peak.

21. The method of claim 20 wherein a safe work area on the roof comprises an area that is (1) in the second direction relative to the selected first of the plurality of tether line anchor points (2) in the fourth direction relative to the selected first of the plurality of first lifeline anchor points, (3) in the sixth direction relative to the selected first of the plurality of support line anchor points, and (4) in the eighth direction relative to the selected first of the plurality of second lifeline anchor points.

22. The method of claim 20 wherein the roof comprises a corner disposed between (1) the first anchoring device or the second anchoring device and (2) the third anchoring device; and wherein a safe work area comprises the corner.

23. The method of claim 19 wherein the roof comprises at least two sloped surfaces forming a peak and wherein the single tether line is configured to extend over and contact the peak; and wherein the attaching the support line slidable element to the support line comprises orienting the support line slidable element on the support line so that the fifth direction is towards the single tether line.

24. The method of claim 19, wherein a first work area on the roof is defined by the selected first of the plurality of tether line anchor points, the selected first of the plurality of first lifeline anchor points, the selected first the plurality of support line anchor points, and the selected first of the plurality of second lifeline anchor points.

25. The method of claim 24, further comprising selecting a second work area on the roof, wherein the selecting the second work area comprises:

sliding the first user slidable element along the first lifeline and anchoring at a selected second of the plurality of first lifeline anchor points; or sliding the tether line slidable element along the single tether line and anchoring at a selected second of the plurality of tether line anchor points; or sliding the first user slidable element along the second lifeline and anchoring at a selected second of the plurality of second lifeline anchor points; or sliding the support line slidable element along the support line and anchoring at a selected second of the plurality of support line anchor points; or a combination thereof.

26. The method of claim 1, wherein the non-penetrating fall protection systems comprises at least two of the tether line slidable elements;

wherein attaching the tether line slidable elements to the single tether line comprises attaching a first tether line slidable element and a second tether line slidable element to the single tether line in opposing orientations, such that the first direction for the first tether line slidable element is toward the second tether line slidable element and the first direction for the second tether line slidable element device is toward the first tether line slidable element, to prevent motion of the first end of the first lifeline attached to either of the first tether line slidable element or the second tether line slidable element in both the first direction and in the second direction.

27. The method of claim 1, wherein a safe work area on the roof comprises an area that is (1) in the second direction relative to the selected first of the plurality of tether line anchor points and (2) in the fourth direction relative to the selected first of the plurality of first lifeline anchor points.

* * * * *